United States Patent [19]

Freeman et al.

[11] 4,453,504

[45] Jun. 12, 1984

[54] SINGLE PISTON, DOUBLE CHAMBERED RECIPROCAL INTERNAL COMBUSTION ENGINE

[75] Inventors: Lawrence M. Freeman, Atlanta; Donald A. Simpson, Lilburn, both of Ga.

[73] Assignee: Germicidal Electronics, Inc., Doraville, Ga.

[21] Appl. No.: 28,163

[22] Filed: Apr. 9, 1979

[51] Int. Cl.[3] ..... F02B 75/26

[52] U.S. Cl. ..... 123/52 B; 123/58 C

[58] Field of Search ..... 123/63, 52 B, 58 R, 123/58 A, 58 C, 58 AA

[56] References Cited

U.S. PATENT DOCUMENTS

| | | | |
|---|---|---|---|
| 998,363 | 7/1911 | Lukacsevics | 123/58 C |
| 1,276,346 | 8/1918 | Gould | 123/63 |
| 1,545,925 | 7/1925 | Powell | 123/58 C |
| 3,570,463 | 3/1971 | Nelson | 123/58 C |
| 3,786,790 | 1/1974 | Plevyak | 123/58 C |

FOREIGN PATENT DOCUMENTS

| | | | |
|---|---|---|---|
| 399538 | 6/1909 | France | 123/52 B |

*Primary Examiner*—Craig R. Feinberg
*Attorney, Agent, or Firm*—B. J. Powell

[57] ABSTRACT

An engine with a cylinder assembly defining a cylinder chamber therein in which is reciprocally mounted a piston on a support tube slidably projecting on opposing ends of the cylinder chamber. A drive shaft is rotatably mounted through the support tube and a camming arrangement connects the piston and drive shaft to convert the reciprocal motion of the piston into rotary motion of the drive shaft. A pair of roller and guides alignment mechanisms are connected to opposite ends of the support tube externally of the cylinder assembly to prevent the piston from rotating but permit reciprocal motion thereof.

11 Claims, 19 Drawing Figures

FIG 7
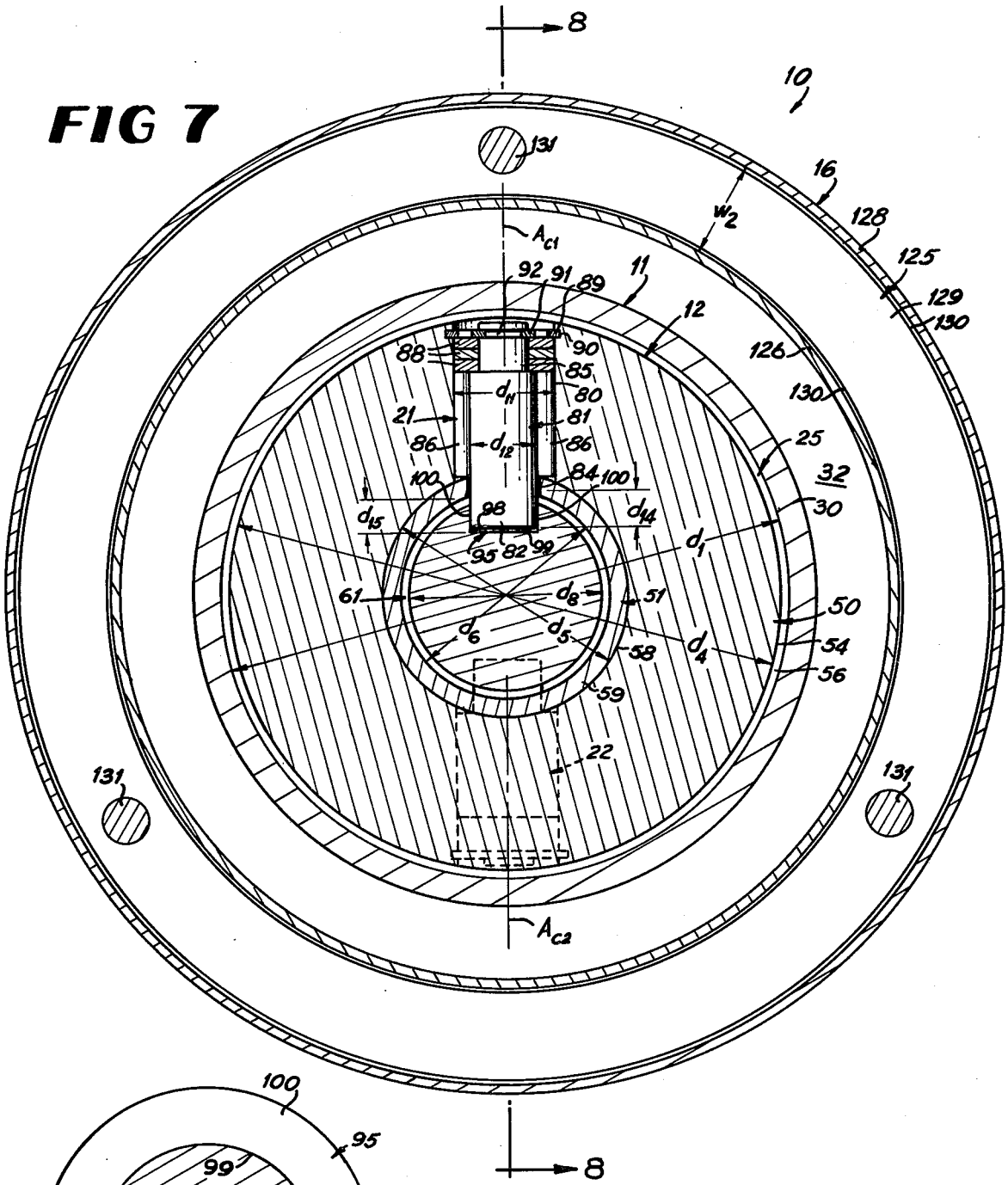
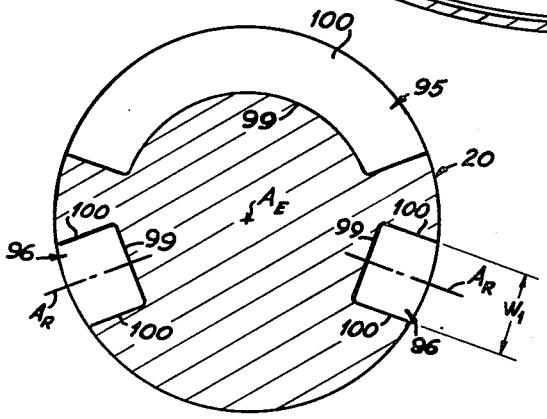
FIG 9

FIG 10
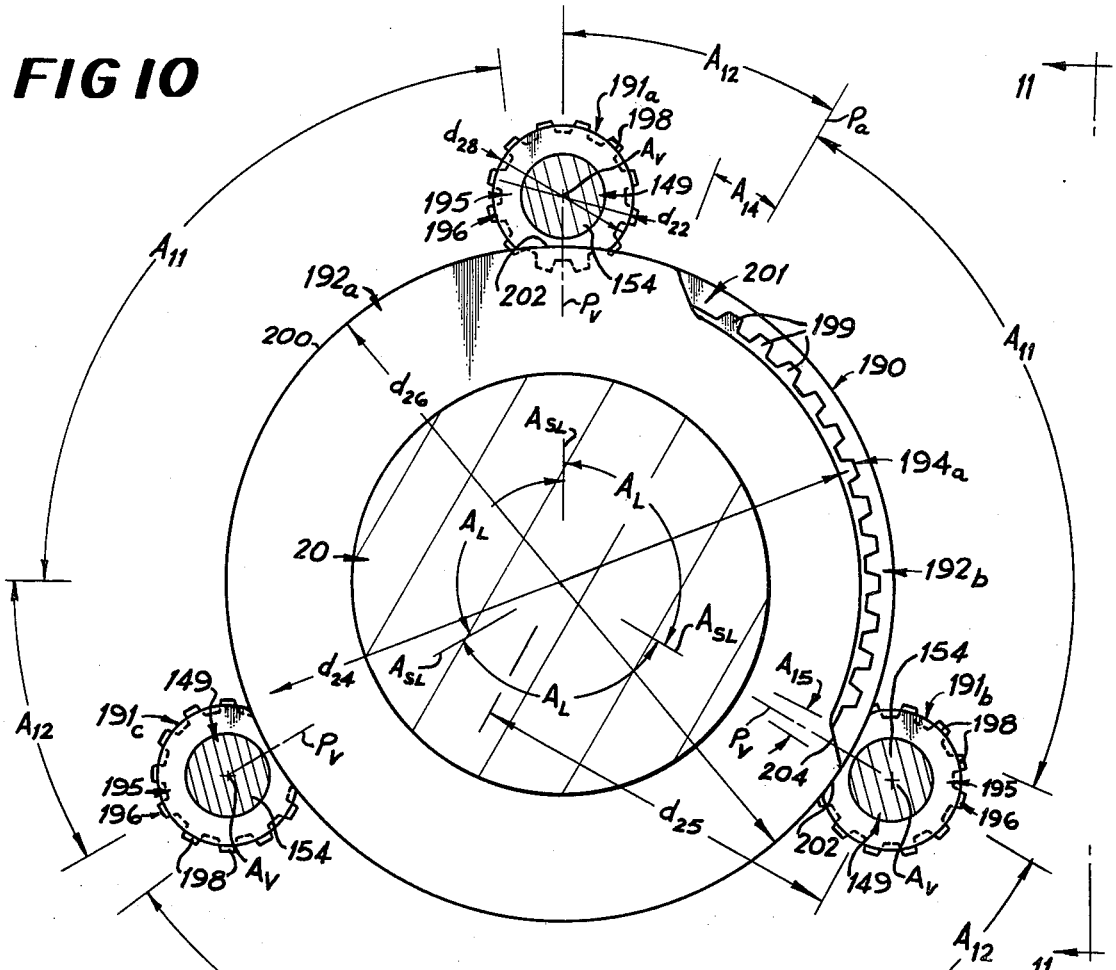
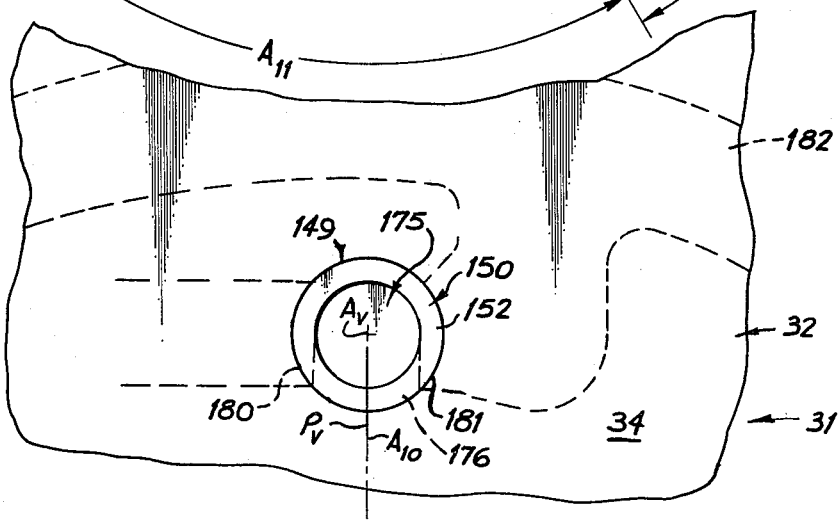
FIG 13

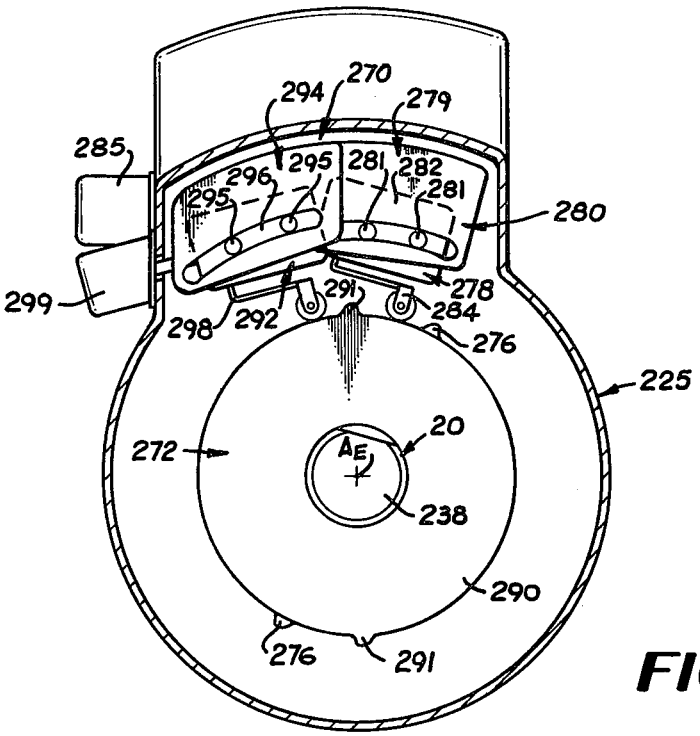
FIG 15
FIG 16
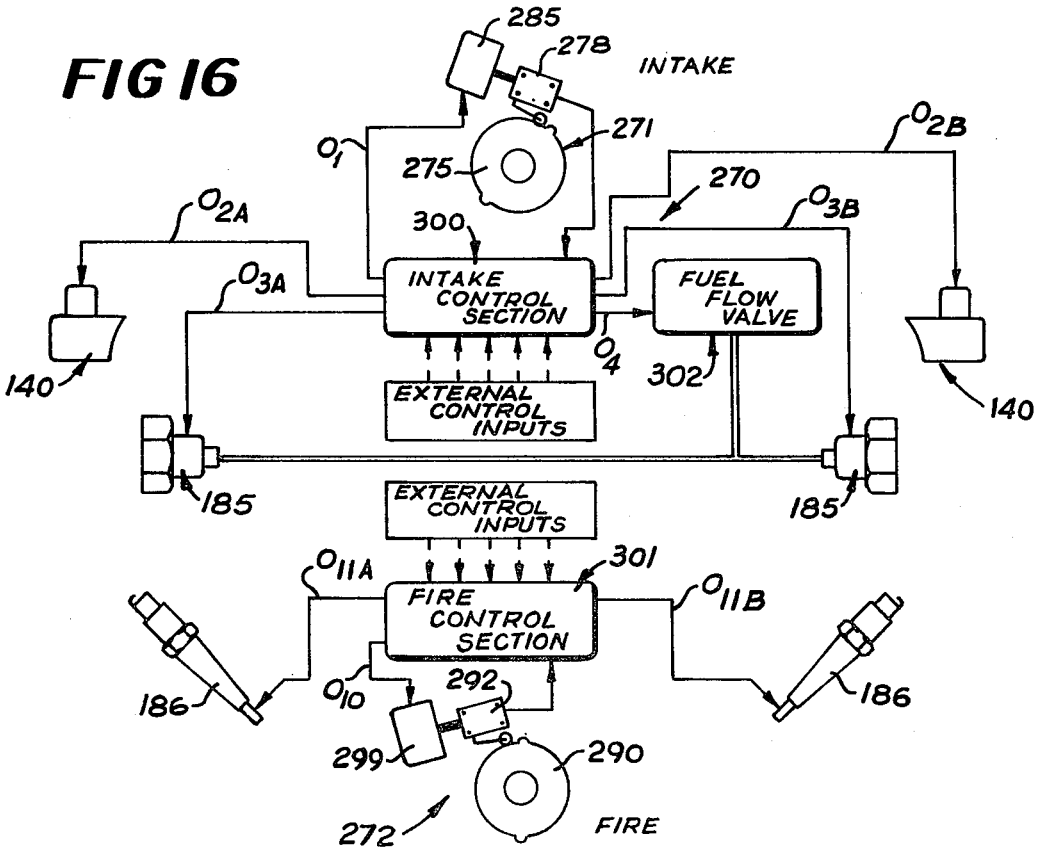

SINGLE PISTON, DOUBLE CHAMBERED RECIPROCAL INTERNAL COMBUSTION ENGINE

BACKGROUND OF THE INVENTION

This invention relates generally to engines, pumps, and the like, and more particularly to an engine, pump, or the like which converts the reciprocatory motion of a piston carried in a chamber directly into rotary motion in an output drive shaft through an endless cyclodial type camming arrangement connecting the piston with the output shaft.

Numerous attempts have been made to produce an engine where the reciprocatory motion of the piston in a chamber is converted into rotary motion of a shaft by a direct camming arrangement connecting the piston to the shaft. Examples of these attempts are illustrated in U.S. Pat. Nos. 1,197,591; 3,388,603 and 3,828,655.

One of the primary problems associated with these prior art engines is the difficulty in sealing the working chamber of the engine while still permitting the direct connection between the piston and the rotary output shaft. As a result, considerable loss of efficiency and leakage problems were encountered with these prior art engines. Another problem encountered with these prior art engines is that the direct camming arrangement connecting the piston and output shaft so that the reciprocatory motion of the piston is transferred to rotary motion in the output shaft was not sufficiently strong to prevent rapid wear thereof and not sufficiently supported to prevent damage thereto during use. Also contributing to these deficiencies was the inability of these prior art engines to keep the camming arrangement cool and lubricated so as to prevent damage thereto during use. Yet another problem with these prior art engines is that it is difficult to control the motion of the working fluid in the engine, especially those engines of the internal combustion type which require timed intake of an unburned air-fuel mixture and timed exhaust of the products of combustion therefrom.

SUMMARY OF THE INVENTION

These and other problems and disadvantages associated with the prior art are overcome by the invention disclosed herein by providing an engine, pump or the like which includes a cylinder assembly defining a working chamber therein and which reciprocally mounts a piston assembly in the working chamber where the piston assembly has a piston mounted on a support tube that extends out through the cylinder heads at opposite ends thereof. The rotational attitude of the piston assembly is controlled by engaging the ends of the support tube exteriorly of the cylinder heads so as to minimize the sealing problems associated with the working chamber. The piston assembly defines a central drive shaft passage therethrough through which a drive shaft supported exteriorly of the piston assembly rotatably extends. The drive shaft is directly connected to the piston through a camming arrangement so that the reciprocatory motion of the piston is converted directly into rotary motion of the drive shaft as the engine, pump or the like is operated. Because the alignment means engages the support tube of the piston assembly exteriorly of the cylinder heads to prevent rotational movement of the piston assembly about the engine central axis while permitting axial reciprocatory motion of the piston assembly and because the drive shaft is rotatably supported for rotation about the engine central axis yet axially fixed with respect thereto exteriorly of the support tube on the piston assembly, the sealing of the working chamber and the cylinder assembly is greatly facilitated by permitting the use of simple ring type seals around the piston itself in the working chamber and around the support tube where the support tube passes through opposite cylinder heads in the cylinder assembly. This arrangement also serves to isolate the hot working fluid from the camming arrangement and drive shaft to facilitate both the cooling thereof and the lubrication thereof.

Also provided is a valving arrangement which permits the individual valves controlling the working fluid to the working chamber to both control the intake of the working fluid into the working chamber and the exhaust of the working fluid from the working chamber. Also provided is supercharging means driven by the reciprocatory motion of the piston assembly to selectively supercharge the working fluid prior to intake into the working chamber by raising the pressure thereof.

These and other features and advantages of the invention will become more clearly understood upon consideration of the following specification and accompanying drawings wherein like characters of reference designate corresponding parts throughout the several views and wherein:

BRIEF DESCRIPTION OF THE DRAWINGS

FIG. 7 is an enlarged transverse cross-sectional view taken generally along line 7—7 in FIG. 2;

FIG. 9 is an enlarged transverse cross-sectional view taken generally along line 9—9 in FIG. 8;

FIG. 10 is an enlarged transverse cross-sectional view taken generally along line 10—10 in FIG. 2;

FIG. 13 is an enlarged view taken generally along line 13—13 in FIG. 2;

FIG. 15 is an enlarged cross-sectional view taken generally along line 15—15 in FIG. 14;

FIG. 16 is an electro-mechanical schematic illustrating the intake and firing control system;

These figures and the following detailed description disclose specific embodiments of the invention; however, the inventive concept is not limited thereto since it may be embodied in other forms.

DETAILED DESCRIPTION OF ILLUSTRATIVE EMBODIMENTS

The invention of this application is applicable to engines, motors, pumps and the like by making the appropriate changes in the working fluid associated therewith and the timing of the injection and exhaust of the working fluid from the working chamber. The invention is specifically disclosed as an engine of the internal combustion type whose operation principle is based on the Otto cycle using gasoline or some similar combustible fuel. The operation thereof could also be classified as a two-cycle type operation. It is easily seen that the engine could be changed to a four-cycle type operation or to diesel type operation with minor modifications thereof. For sake of clarity, the invention will be referred to hereinafter simply as an engine, it being understood that the appropriate modifications could be made thereto for the invention to operate as a motor, pump or the like.

Figure 1:
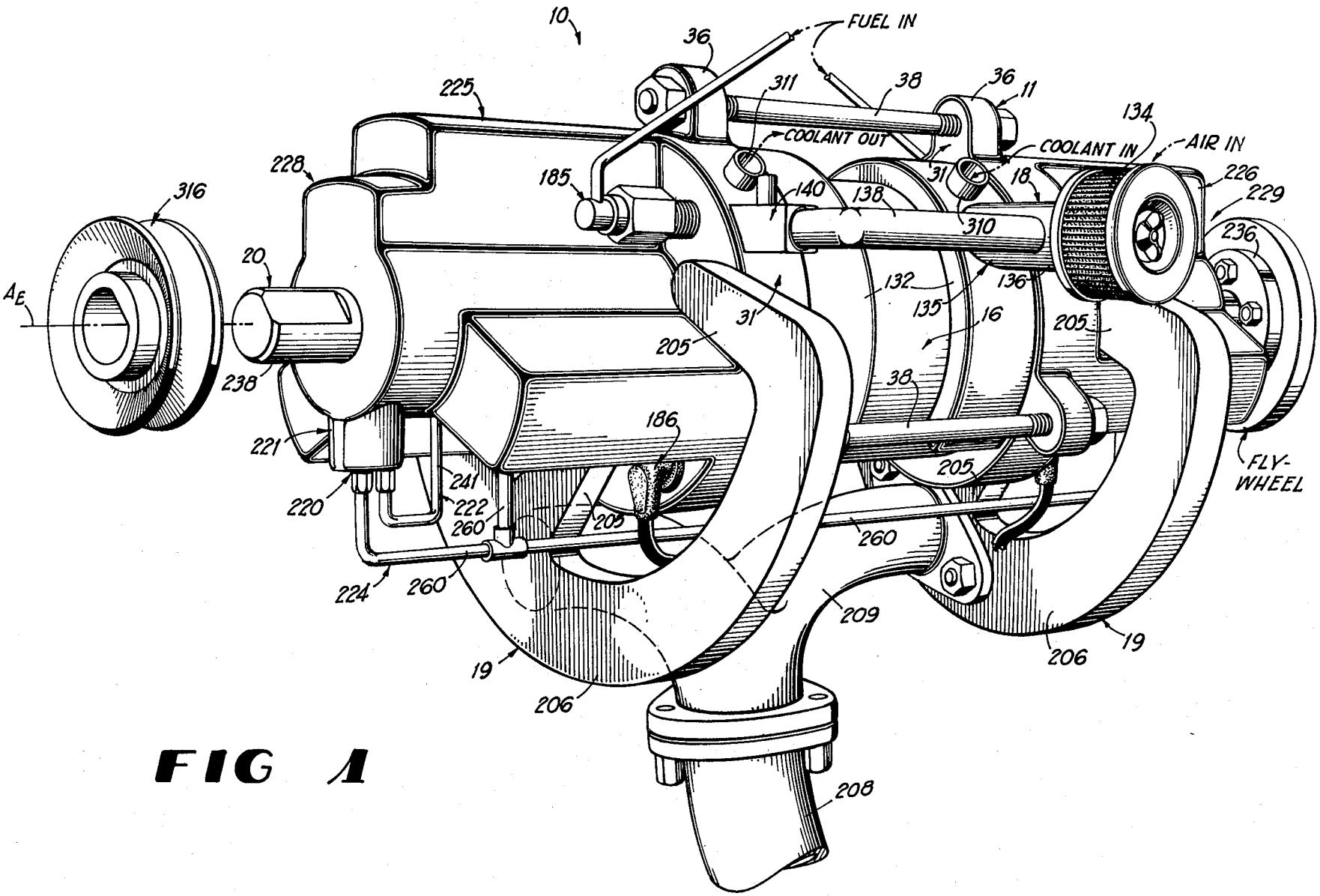
FIG. 1 is a perspective view of the engine.
Figure 2:
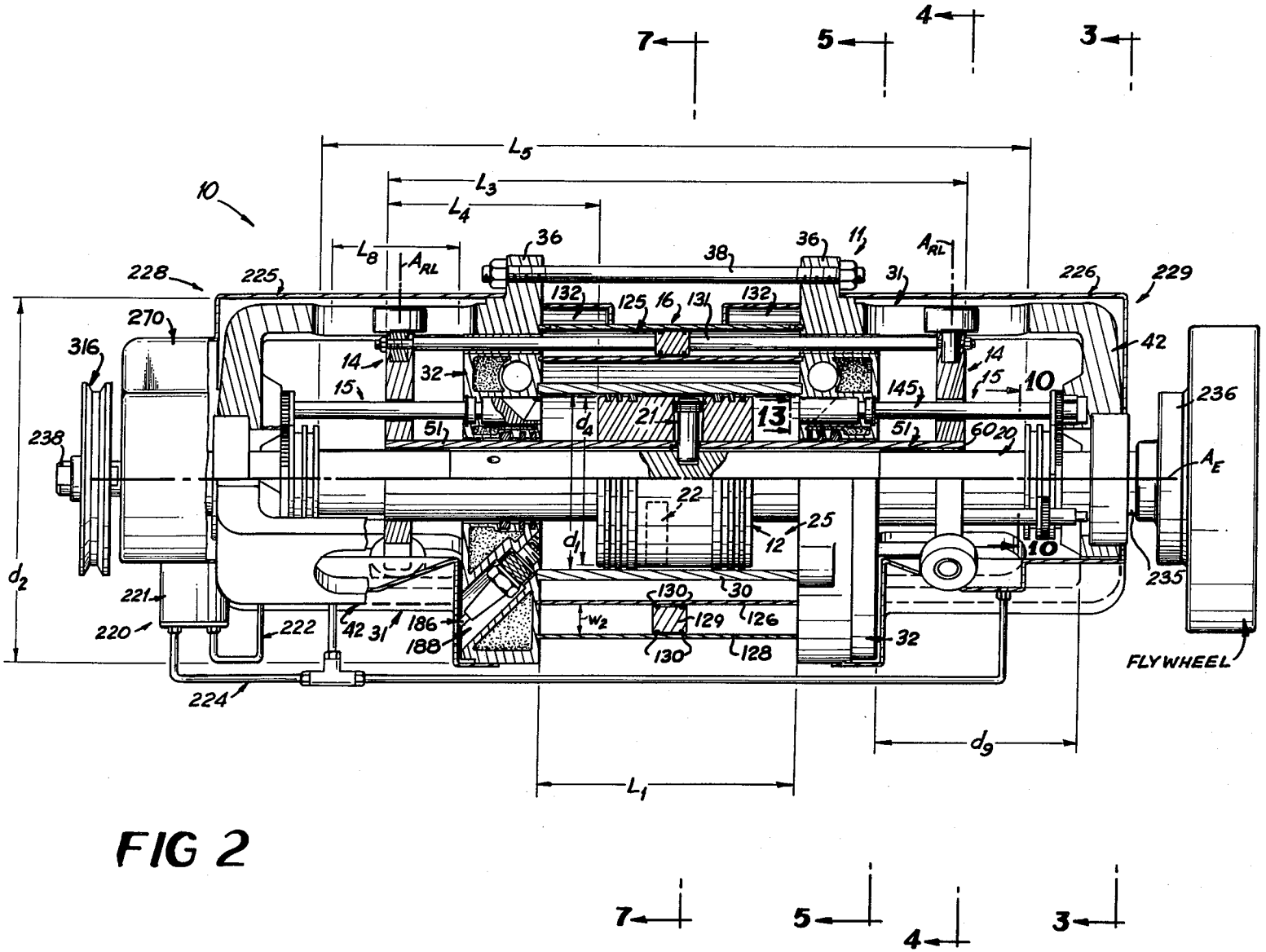
FIG. 2 is a longitudinal cross-sectional view of the engine shown partly broken away to show the internal construction thereof.

Referring to the FIGS. 1 and 2, it will be seen that the engine 10 includes generally a cylinder assembly 11, a piston assembly 12, a pair of alignment assemblies 14, a pair of valve assemblies 15, a supercharger assembly 16, a pair of intake manifold assemblies 18, and a pair of exhaust manifold assemblies 19. A drive shaft 20 is operatively connected to the piston assembly 12 via a pair of camming assemblies 21 and 22 so that the reciprocatory motion of the piston assembly 12 is converted directly into rotary motion of the drive shaft 20 via the camming assemblies 21 and 22.

Basically, the cylinder assembly 11 reciprocally mounts the piston assembly 12 therein with the drive shaft 20 extending therethrough for rotary movement about the engine axis $A_E$. The piston assembly 12 extends out of opposite ends of the cylinder assembly 11 and is engaged by the pairs of alignment assemblies 14 so that the piston assembly 12 is reciprocally movable with respect to the cylinder assembly 11; however, the alignment assembly 14 prevents the rotation of the piston assembly 12 with respect to the cylinder assembly 11. The drive shaft 20, on the other hand, is axially fixed with respect to the cylinder assembly 11 but freely rotatable with respect thereto so that, with the camming assemblies 21 and 22 connecting the piston assembly 12 with the drive shaft 20, the reciprocatory motion of the piston assembly 12 will directly drive the drive shaft 20 in rotation.

The valve assemblies 15 alternatively introduce working fluid into the working chamber 25 in the cylinder assembly 11 and exhaust working fluid from the working chamber 25 so that the working fluid reciprocally drives the piston back and forth within the working chamber 25. Because the engine 10 is described as an internal combustion type engine, the intake working fluid is an air-fuel mixture while the exhaust working fluid is the gases of the combustion after the air-fuel mixture has been fired in the working chamber 25.

The supercharger assembly 16 serves to pressurize the intake air before it is injected into the working chamber 25 so as to supercharge this air. In the particular embodiment shown, the fuel is introduced into the intake air after it has been supercharged; however, it is to be understood that the fuel could be injected into the intake air prior to supercharging. The intake manifold assemblies 18 selectively introduce the intake air into the supercharger assembly 16 while the exhaust manifold assemblies 19 are connected to the exhaust gases coming out of the working chamber 25.

CYLINDER ASSEMBLY

The cylinder assembly 11 is best seen in FIG. 2 and includes generally an annular cylindrical side wall 30 of constant inside diameter $d_1$ with its opposite ends cut normal to the axis of the side wall 30 lying along the engine axis $A_E$ in the engine 10. These opposite ends of the side wall are closed by a pair of cylinder head assemblies 31 to form the working chamber 25 therein of the diameter $d_1$ and a length $L_1$ seen in FIGS. 2 and 8. Each of the cylinder head assemblies 31 includes a disk shaped cylinder head 32 with an outside diameter $d_2$ considerably larger than the inside diameter $d_1$ of the cylinder side wall 30 as will become more apparent.

Figure 8:
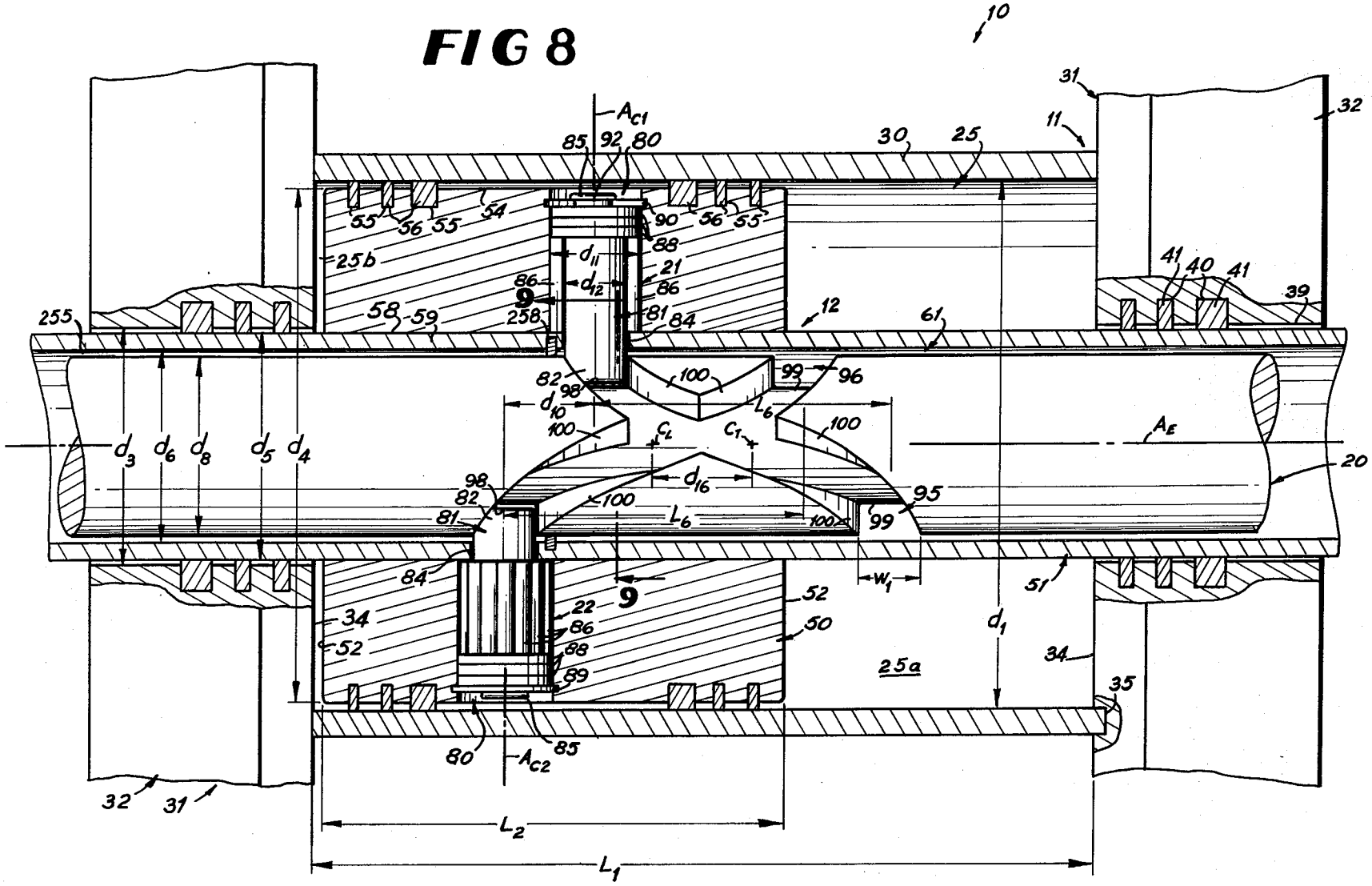
FIG. 8 is a longitudinal cross-sectional view taken generally along line 8—8 in FIG. 7.

Each cylinder head 32 defines a working face 34 (FIGS. 2, 7 and 8) which faces the working chamber 25 defined between the heads 32 and cylinder side wall 30. This working face 34 is normal to the central axis of the cylinder head 32 lying along the engine axis $A_E$ when the cylinder head is in position. The cylinder head 32 defines an annular groove 35 (FIG. 8) therein which opens onto the working face 34 and is sized to receive the end of the cylinder side wall 30 therein in sealing engagement therewith so as to seal the working chamber 35. Each of the cylinder heads 32 is provided with a plurality of attachment tabs 36 (FIGS. 1 and 2) through which clamping bolts 38 extend to clamp the cylinder head assemblies 31 onto opposite ends of the cylinder side wall 30 and maintain the working chamber 25 sealed. It will be noted that each of the cylinder heads 32 further defines a support passage 39 therethrough of diameter $d_3$ as best seen in FIGS. 2 and 8 as will become more apparent. Appropriate ring grooves 40 are provided around the support passage 39 in planes generally normal to the engine axis $A_E$ to receive sealing rings 41 therein (FIG. 8) which seal with the piston assembly 12 as will become more apparent.

Each of the cylinder head assemblies 31 further includes a support assembly 42 mounted on and extending exteriorly outward of the cylinder head 32. The support assembly 42 serves to support and control the alignment assemblies 14, the valve assemblies 15 and the drive shaft 20 as will become more apparent.

PISTON ASSEMBLY

The piston assembly 12 includes a piston 50 (FIGS. 2, 7 and 8) mounted on a support tube 51. The piston 50 is cylindrical in shape with its central axis coaxial with the engine axis $A_E$ and has an outside diameter $d_4$ which is slightly smaller than the inside diameter $d_1$ of the working chamber 25 as best seen in FIG. 8. The piston 50 has opposed end faces 52 which are arranged generally normal to the central axis of the piston so that they lie normal to the engine axis $A_E$. The piston 50 has an overall length $L_2$ which is shorter than the length $L_1$ of the working chamber 25 so that the piston 50 can reciprocally move within the chamber 25 along the engine axis $A_E$. Ring grooves 55 are provided around the piston 50 and lie generally in planes normal to the engine axis $A_E$ with the ring grooves 55 opening onto the exterior annular surface 54 of the piston 50 so that sealing rings 56 carried in the ring groove 55 serve to seal the piston 50 to the cylinder side wall 30 yet allows the piston 50 to reciprocate within the working chamber 25. The length $L_2$ of the piston 50 is selected so that the piston 50 can reciprocate in the working chamber 55 for the desired stroke as will become more apparent without hitting the cylinder heads 32. The piston 50 further defines a central passage 58 (FIGS. 7 and 8) therethrough concentrically about its central axis $A_E$ with a diameter $d_5$ as will become more apparent.

The support tube 51 is cylindrical in shape with an annular tube wall 59 (FIGS. 7 and 8) of outside diameter $d_5$ so that the support tube 51 just fits within the central passage 58 through the piston 50. The support tube 51 is affixed to the piston 50 intermediate its ends, here shown as centered on the support tube 51 move as an integral unit. It will likewise be understood that the support tube 50 may be made integral with the piston 50 without departing from the scope of the invention. The support tube 51 has an overall length $L_3$ (FIG. 2) such that the support tube 51 extends exteriorly of both of the cylinder heads 32 and remains projecting exteriorly out of the cylinder heads 32 regardless of the position of the piston 50 in its reciprocal stroke. Thus, the support tube 51 projects from both ends of the piston 50 a distance $L_4$ (FIG. 2); however, it is to be understood that the support tube 51 may project outwardly from each end of the piston 50 different lengths depending on the particular requirements as long as the support tube 51 projects outwardly from both ends of the piston 50 sufficiently for the outboard ends 60 (FIG. 2) of the support tube 51 to always lie exteriorly of the cylinder heads 32 regardless of the position of piston 50 along its reciprocal stroke.

It will be noted that the support tube 51 has the outside diameter $d_5$ which is slightly less than the inside diameter $d_3$ of the support passages 39 through the cylinder heads 32 so that the support tube 51 extends therethrough in clearance. The sealing rings 41 carried in the support passages 39 sealingly engage the exterior surface of the support tube 51 to form a seal at opposite ends of the working chamber 25 in the cylinder assembly 11.

Thus, with rings 41 sealing the support tube 51 to cylinder heads 32 and rings 56 sealing piston 50 to the cylinder side wall 30, the piston assembly 12 divides the working chamber 25 into a pair of opposed annular working subchambers labelled **25*a* on the right and 25*b* on the left in FIG. 8. These subchambers 25*a* and 25*b*, of course, vary in size as piston 50 reciprocates. This arrangement allows the subchambers 25*a* and 25*b* to be easily and simply sealed while at the same time exposing only the piston 50 and those portions of support tube 51 within chamber 25 to the heat of combustion in subchambers 25*a* and 25*b* to facilitate cooling and lubrication as will become more apparent. It will also be noted that the sealing rings 41 and 56** may vary in cross-sectional shape depending on the particular requirements of these rings as is well known in the art.

The support tube 51 defines a drive shaft passage 61 (FIGS. 7 and 8) therethrough of diameter $d_6$ so that the drive shaft 20 can be received therethrough. The drive shaft 20 is an elongate cylindrical member having an effective working length $L_5$ (FIG. 2) which is longer than the length $L_3$ of the support tube 51 as will become more apparent. The drive shaft 20 has an outside diameter $d_8$ (FIG. 8) which is slightly less than the inside diameter $d_6$ of the drive shaft passage 61 so that the drive shaft 20 extends through the drive shaft passage 61 in clearance therewith when the drive shaft 20 is maintained with its central axis coinciding with the engine axis $A_E$ as is illustrated in the drawings. It will thus be noted that the opposite ends of the drive shaft 20 project outwardly beyond the outboard ends 60 of the support tube 51 so that the drive shaft 20 can be rotatably supported exteriorly of the support tube 51 without interference with the support 51 as the support tube 51 reciprocates with the piston 50.

Figure 3:
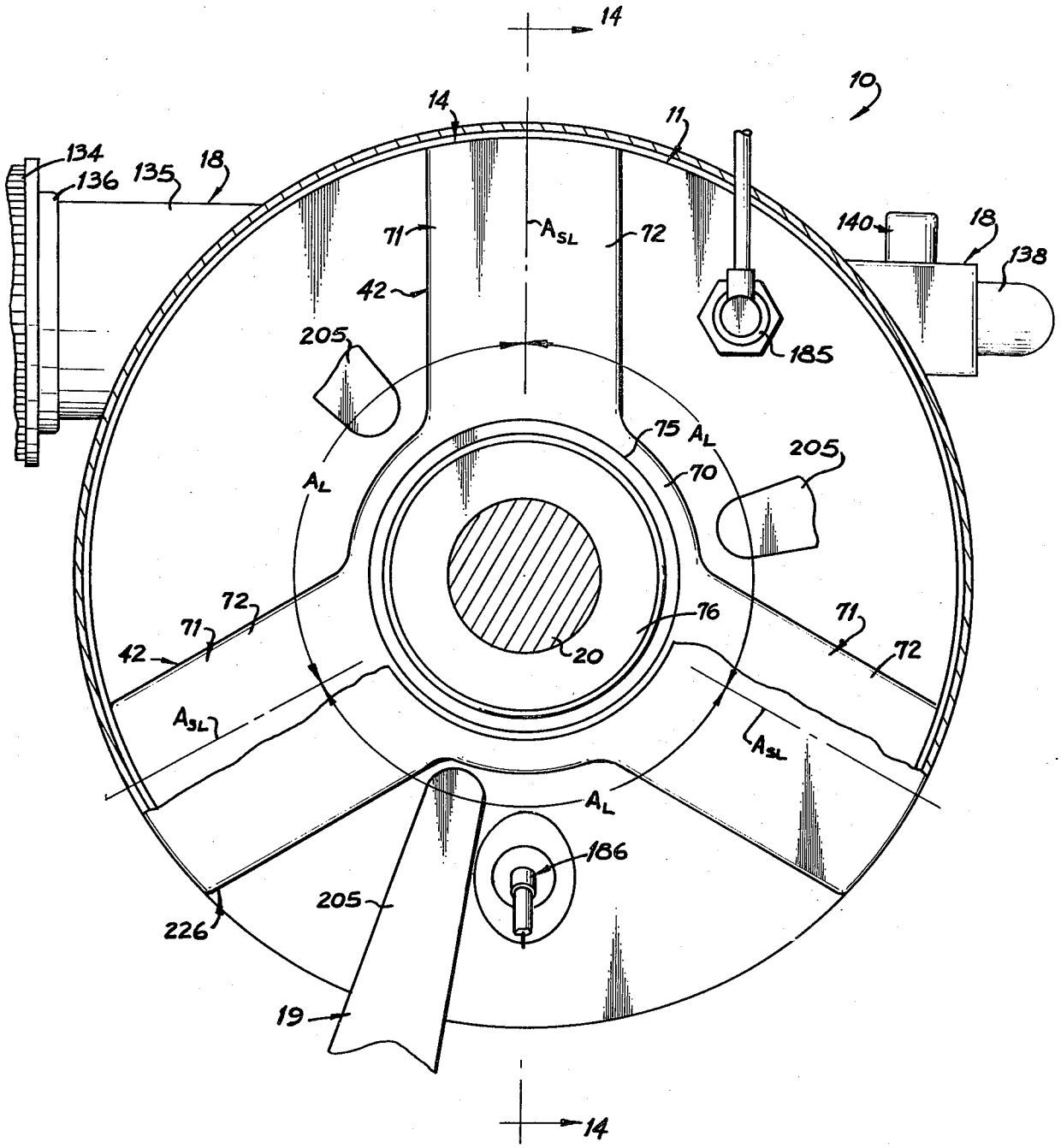
FIG. 3 is an enlarged transverse cross-sectional view taken along line 3—3 in FIG. 2.

The support assemblies 42 on the cylinder head assemblies 31 rotatably support the drive shaft 20 therebetween so that it remains coaxially of the engine axis $A_E$. The support assembly 42 of each of the cylinder head assemblies 31 includes a generally circular central web 70 (FIGS. 3 and 10) which axiaally supports one of the ends of the drive shaft 20 together with outwardly projecting L-shaped legs 71 (FIGS. 2 and 3). While the particular number of L-shaped legs 71 may vary, three such legs are illustrated and are equally spaced circumferentially by angles $A_L$ (FIGS. 3 and 4) about the circular web 70 so that each of the L-shaped legs has a radially outwardly extending portion 72 along axis $A_{SL}$ (FIGS. 2 and 3), the inboard end of which is integral with the central web 70, and which is oriented in a plane generally normal to the engine central axis $A_E$. The outboard ends of the outwardly extending portions 72 are integral with the outboard end of a spacer portion 74 (FIG. 2) of each of the L-shaped legs 71 which extends generally parallel to the engine central axis $A_E$ back toward the cylinder head 32. The inboard end of the spacer portion 74 is illustrated integral with the cylinder head 32; however, it is to be understood that the spacer portion 74 may be simply attached thereto. Thus, the spacer portions 74 are supported by the cylinder head 32 with the spacer portions maintaining the radially outwardly extending portions 72 of the legs 71 normal to the central axis $A_E$. The radially outwardly extending portions 71 of the L-shaped legs 71 thus main the central web 70 normal with the engine central axis $A_E$ and spaced outwardly of the cylinder head 32 a distance $d_9$ as best seen in FIG. 2. The distance $d_9$ is sufficient to space the central webs 70 of the support assemblies 42 sufficiently far from the cylinder heads 32 to prevent the outboard ends 60 of the support tube 51 from interfering with the support assemblies 42.

Each of the central webs 70 defines a bearing receiving recess 75 therein concentrically of the engine axis $A_E$ sized to receive support bearings 76 which both rotatably support the drive shaft 20 therein while at the same time maintaining the drive shaft 20 axially fixed with respect to the cylinder assembly 11. Thus, it will be seen that the support bearings 76 maintain the drive shaft 20 rotatably centered on the engine axis $A_E$ while at the same time axially centered and axially fixed with respect to the engine axis $A_E$.

CAMMING ASSEMBLIES

As viewed in FIG. 7, the camming assemblies 21, and 22 are carried by the piston 50 and diametrically opposed to each other across the engine axis $A_E$. It will further be noted, as seen in FIG. 8, that the camming assemblies 21 and 22 are shifted with respect to each other axially along the engine axis $A_E$ a distance $d_{10}$. Camming assemblies 21 and 22 are mounted in radially extended cylindrical passages 80 in piston 50 as seen in FIGS. 7 and 8. These radially extending passages 80 have a diameter $d_{11}$, and open onto the exterior annular surface 54 of the piston 50 at their outboard end and onto the central passage 58 at their inboard ends. Each of the cylindrical passages 80 are centered on radial axes $A_{C1}$ and $A_{C2}$ so that the axis $A_{C1}$ and $A_{C2}$ are diametrically aligned when viewed as in FIG. 7 and axially shifted the distance $d_{10}$ viewed as seen in FIG. 8.

Both camming assemblies 21 and 22 have the same construction and, therefore, only camming assembly 21 will be described in detail while like reference numbers will be applied to the camming assembly 22. Camming assembly 21 includes a generally cylindrical cam pin 81 (FIGS. 7 and 8) with its inboard camming end 82 projecting through a cylindrical passage 84 in the annular tube wall 59 of support tube 51 concentric of the cam axis $A_{C1}$ so that the inboard camming end 82 of the cam pin 81 is in free running clearance with the passage 84. The outboard end of the cam pin 81 is provided with a reduced diameter cylindrical section 85 (FIG. 7) as will become more apparent. The main section of the cam pin 81 together with the outboard camming end 82 is at diameter $d_{12}$ (FIGS. 7 and 8) as will become more apparent. It will be noted that the diameter $d_{12}$ is less than the diameter $d_{11}$ of the passages 80 in the piston 50.

A plurality of needle bearings 86 (FIGS. 7 and 8) are positioned around the cam pin 81 in the passage 80 in piston 50 so that the cam pin 81 is rotatably supported about the axis $A_{C1}$ for free rotation of the cam pin 81 about the axis $A_{C1}$. To axially locate the cam pin 81 along the axis $A_{C1}$, and to provide bearing against axial thrust on the cam pin 81, a plurality of thrust washers 88 (FIGS. 7 and 8) are rotatably positioned around the reduced diameter cylindrical section 85 on the outboard end of the cam pin 81. The thrust washers 88 are held in position by a snap ring 89 (FIG. 7) fitted in a ring groove 90 (FIGS. 7 and 8) provided in piston 50 around the outboard end of the cylindrical passage 80 to prevent the thrust washers 88 and, thus, the cam pin 81 from moving outwardly along the cam axis $A_{C1}$. The support tube 51 limits the axial inward movement of the needle bearings 86 with respect to the axis $A_{C1}$ around passage 84. The outboard ends of needle bearings 86 limit the inward movement of the thrust washers 88. The cam pin 81 is axially fixed against inward movement along the axis $A_{C1}$ by a snap ring 91 (FIG. 7) which fits in a ring groove 92 (FIGS. 7 and 8) adjacent the outboard end of the reduced diameter cylindrical section 85 on the cam pin 81. It will be noted that the length of the reduced diameter cylindrical section 85 and the location of the ring groove 92 is such that the outboard end of the cam pin 81 lies within the confines of the exterior annular surface 54 of the piston 50 as seen in FIGS. 7 and 8 so that the piston 50 is free to move reciprocally along the cylinder side wall 30 without interference between the cam pin 81 and the cylindrical side wall 30. It will also be noted that the cam pin 81 has a length such that the inboard camming pin 82 projects inwardly of the support tube 51 the distance $d_{14}$ (FIG. 7) as will become more apparent.

The inboard camming ends 82 of the cam pins 81 of the camming assemblies 21 and 22 have separate endless cyclodial slots 95 and 96 (FIGS. 7–9) respectively associated therewith in the drive shaft 20 so that reciprocal motion of the piston 50 and the camming assemblies 21 and 22 rotatably drive the drive shaft 20. The cam slot 95 is associated with the camming assembly 21 while the cam slot 96 is associated with the camming assembly 22. The cam slots 95 and 96 extend around the drive shaft 20 so that the reciprocal motion of the piston assembly 12 causes a substantially constant rotational speed in the drive shaft 20 along the length of each stroke of piston 50 to insure smooth engine operation.

Each of the cam slots 95 and 96 has a constant width $w_1$ (FIG. 9) which is about the same as the diameter $d_{12}$ of the inboard camming end 82 of the cam pins 81 to just giving running clearance for the inboard camming ends 82 of the cam pins 81. Also, each of the cam slots 95 and 96 has a depth $d_{15}$ (FIGS. 7–9) such that of the inwardly facing face 98 (FIG. 7) on the inboard camming end 82 of the cam pin 81 clears the bottom 99 of the cam slot 95 and 96. The opposed side surfaces 100 of the cam slots 95 and 96 are oriented so that they are always parallel to a radial axis $A_R$ (FIG. 9) from engine axis $A_E$ which is centered across the cross-sectional width of the slot 95 or 96 so that the inboard camming ends 82 of the cam pins 81 are always in running clearance with the side surfaces 100. Thus, the inboard camming ends 82 of the cam pins 8 roll along these side surfaces 100 and cause the drive shaft 20 to rotate as the piston 50 reciprocates in the chamber 25. It will be noted that each of the cam slots 95 and 96 have an effective axial working length $L_6$ (FIG. 8) which is equal to the reciprocal stroke length of the piston 50. It will also be noted that the effective centers $C_T$ and $C_L$ (FIG. 8) respectively of the cam slots 95 and 96 are appropriately axially offset by the distance $d_{16}$ as best seen in FIG. 8 to match the axial shift $d_{10}$ of the camming assemblies 21 and 22. It will, of course, be appreciated that the cam slots 95 and 96 are axially located along the length of the drive shaft 20 so that the camming slots 95 and 96 remain in registration with the camming assemblies 21 and 22 for the effective operation of the engine 10. Also, it will be seen that the camming assemblies 21 and 22 and the slots 95 and 96 may be axially shifted different from the particular respective distances $d_{10}$ and $d_{16}$ as long as the axial shift in the camming assemblies 21 and 22 matches the axial shift in the cam slots 95 and 96. The axial shifts $d_{10}$ and $d_{16}$ are such that one of the cam pins 81 is in its respective slot 95 or 96 while the other cam pin 81 is passing through the position where slots 95 and 96 cross in order that the pins 81 remain in their respective slot 95 or 96. The camming assemblies 21 and 22 and slots 95 and 96 may be axially shifted sufficiently far for the slots 95 and 96 not to cross without departing from the scope of the invention.

ALIGNMENT ASSEMBLIES

Figure 4:
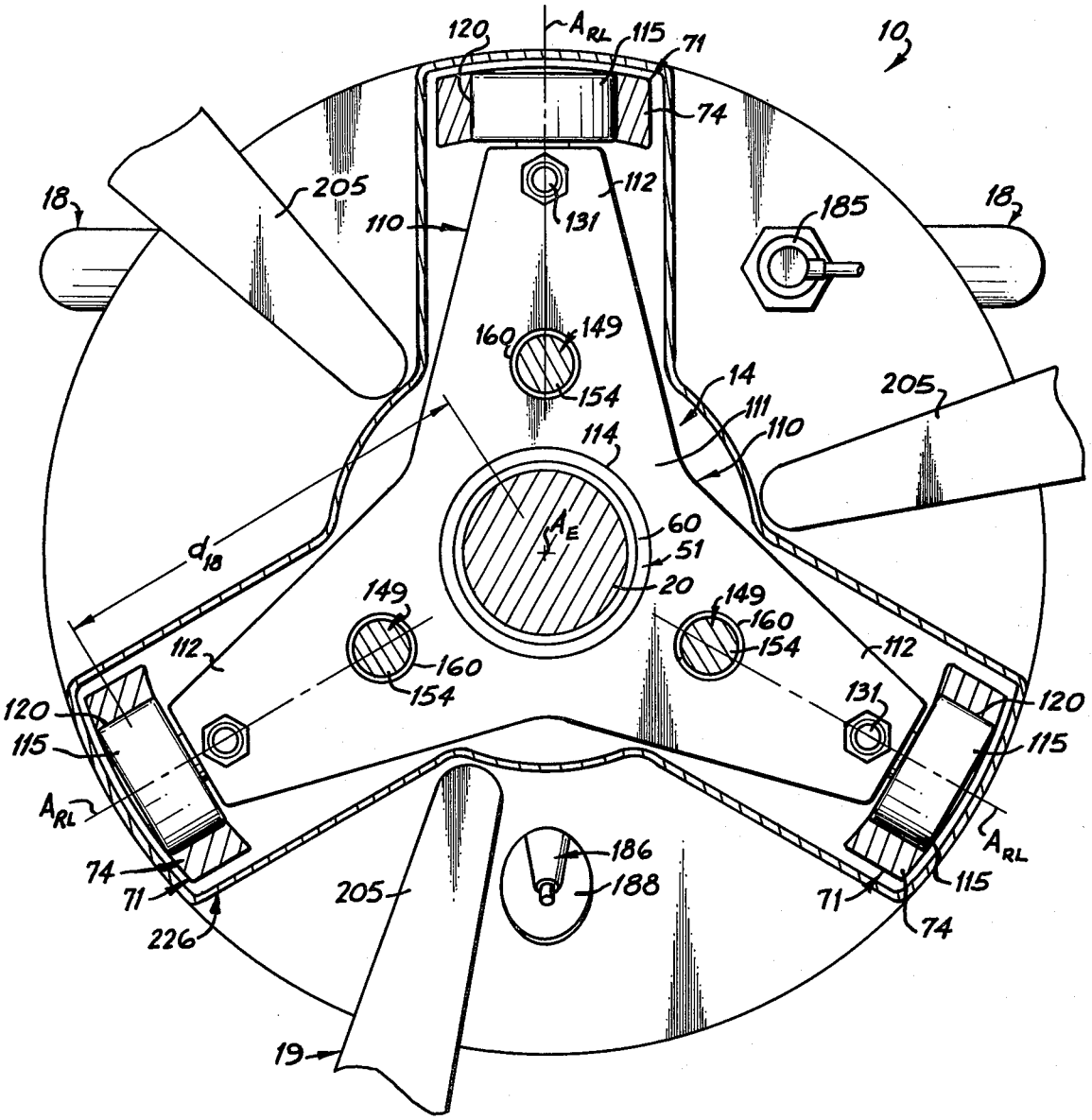
FIG. 4 is an enlarged transverse cross-sectional view taken generally along line 4—4 in FIG. 2.

As best seen in FIGS. 2 and 4, each of the alignment assemblies 14 includes a three-pronged plate 110 having a central web section 111 and three radially extending legs 112 integral therewith and extending outwardly therefrom along equally spaced circumferential positions. The central web section 111 defines an opening 114 therethrough which receives one of the outboard ends 60 of the support tube 51 in the piston assembly 12 therein exteriorly of the cylinder head 32 so that three-pronged plate 110 is oriented generally normal to the engine axis $A_E$. The plate 110 is affixed to the outboard end 60 of the support tube 51 so that the plate 110 reciprocates with tube 51 as the piston assembly 12 is reciprocated.

The legs 112 on plate 110 each mount an alignment roller 115 (FIGS. 2 and 4) thereon about a roller axis $A_{RL}$ (FIG. 4) radially oriented with respect to the engine axis $A_E$. Each of the alignment rollers 115 is located a radial distance $d_{18}$ (FIG. 4) from engine axis $A_E$ so that each of the alignment rollers 115 is in registration with the spacer portion 74 of one of the L-shaped legs 71 on the support assembly 42 of the cylinder head assembly 31. Each of the spacer portions 74 defines an elongate slot 120 (FIGS. 2 and 4) therein whose longitudinal axis is parallel with the engine axis $A_E$ with the slots 120 being centered along the equally spaced apart roller axes $A_{RL}$. Thus, each of the alignment rollers 115 lies within one of the elongate slots 120 so that the alignment roller 115 rolls along the elongate slot 120. It will further be noted that each of the elongate slots 120 has an effective working length $L_8$ (FIG. 2) to permit full reciprocal motion of the piston assembly 12 in the working chamber 25. Because the alignment rollers 115 ride in the elongate slot 120, it will thus be seen that the relative rotational position of the support tube 51 and thus the piston assembly 12 about the engine axis $A_E$ is fixed. Thus, as the piston assembly 12 reciprocates back and forth within the working chamber 25, it is held rotationally fixed so that the camming assemblies 21 and 22 rotate the drive shaft 20 in one rotational direction since the drive shaft 20 is axially fixed with respect to the cylinder assembly 11, yet rotatable about the engine axis $A_E$.

SUPERCHARGER ASSEMBLY

The supercharger assembly 16 best seen in FIGS. 2 and 7 is driven by the alignment assemblies 14 so as to pressurize the intake air to the engine 10 prior to injection of the air in the air-fuel mixture into the working chamber 25. The supercharger assembly 16 includes an annular supercharger chamber 125 (FIG. 2) concentrically located with respect to and outboard of the working chamber 25. The supercharger chamber 125 is defined between inner and outer annular side walls 126 and 128 (FIGS. 2 and 7) so that the supercharger chamber 125 is annular with a radially oriented width $w_2$ (FIGS. 2 and 7) and the axially oriented length $L_1$ of the length of the working chamber 25.

An annular piston 129 (FIGS. 2 and 7) is oriented generally normal to the engine axis $A_E$ and slidably mounted in the supercharger chamber 125 with appropriate inner and outer sealing rings 130 (FIG. 2) sealing the piston 129 to the side walls 126 and 128. The annular piston 129 is drivingly connected to the plates 110 of the alignment assemblies 14 by drive rods 131 (FIGS. 2 and 7) which slidably extend through the cylinder heads 32 outboard of cylinder side wall 30 so that, as the alignment assemblies 14 reciprocate back and forth with the piston assembly 12, the annular piston 129 will be reciprocally driven back and forth along the supercharger chamber 125. It will be noted that the annular piston 129 has a stroke similar to the piston 50 on the piston assembly 12 and is thus approximately centered along the drive rods 131 in the illustrations.

Opposite ends of the supercharger chamber 25 are provided with arcuate transfer chambers 132 (FIGS. 1 and 2) so that the intake air can be introduced into the supercharger chamber 125 on both sides of the annular piston 129 and ejected from the chamber 125. Each arcuate transfer chamber 132 is connected to that end of the supercharger chamber 125 with which it is associated via port 139 best seen in FIG. 2.

INTAKE MANIFOLD ASSEMBLIES

One of the intake manifold assemblies 18 is associated with each of the transfer chambers 132 as best seen in FIGS. 1, 3 and 4. Each intake manifold assembly 18 includes generally an air intake filter 134 (FIG. 1) through which the intake air is introduced into the manifold assembly, an intake manifold 135 (FIGS. 1, 3 and 4) and an intake check valve 136 (FIGS. 3 and 5) connecting air filter 134 with manifold 135 so that the valve 136 permits air to be drawn into the transfer chamber 132 associated therewith through the intake manifold 135 while at the same time preventing air from being ejected back out through the intake filter 134.

A cross-over pipe 138 (FIGS. 1, 3 and 4) connects each intake manifold 135 inboard of valve 136 to the cylinder head 32 at the opposite end of working chamber 25 through a pressure regulator valve 140 (FIG. 1). This arrangement permits the intake air under pressure from the supercharger chamber 125 to be ejected through the transfer chamber 132 associated therewith and into that working subchamber **25*a* or 25*b* at that end of the piston opposite the transfer chamber 132** as will become more apparent.

VALVE ASSEMBLIES

One of the valve assemblies 15 is associated with each of the cylinder heads 32 so that the intake air-fuel mixture can be introduced into the working subchambers **25*a* and 25*b* into which the main working subchamber 25 is divided by the piston 50 and the exhaust gases can be exhausted therefrom. While the valve assemblies 15 can be of different constructions as long as the function thereof remains the same, the valve assemblies 15 illustrated are rotary type valves. It will further be noted that the valve assemblies 15 illustrated each include three rotary valve subassemblies 145 (FIGS. 2 and 5) which are driven by a common drive 146 (FIGS. 2, 10 and 11) from the drive shaft 20**. It is further to be noted that it is within the scope of the invention that one or more rotary valve subassemblies may be used.

Each of the rotary valve subassemblies 145 is mounted between the cylinder head 32 and its associated support assembly 42 on one of the cylinder head assemblies 31. The rotary valve subassemblies 145 in each of the valve assemblies 15 are equally spaced circumferentially about the cylinder head 32 with the rotary valve subassemblies 145 illustrated oriented about valve axes $A_V$ (FIGS. 2 and 4) parallel to the engine axis $A_E$ with the valve axes $A_V$ intersecting with the radial portions 72 on the L-shaped legs 71 of the support assembly 42 and the roller axes $A_{RL}$ of the alignment rollers 115.

Figure 6:
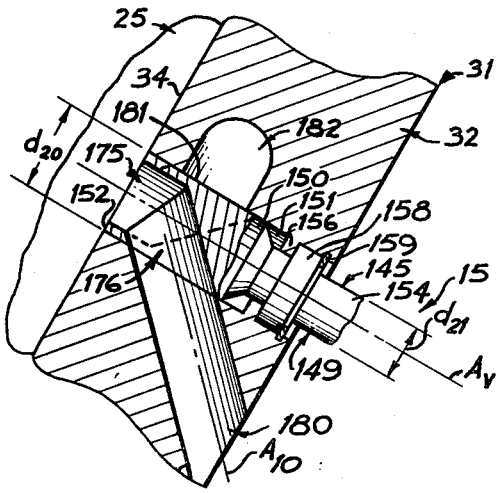
FIG. 6 is a partial cross-sectional view taken generally along line 6—6 in FIG. 5.

Each of the rotary valve subassemblies 145 includes a valve 149 (FIGS. 2 and 6) with a cylindrical valve head 150 (FIG. 6 and 13) rotatably mounted in a valve passage 151 in the cylinder head 32 in registration with the valve axis $A_V$. The cylindrical valve head 150 is sized to just provide rotating clearance in the valve passage 151 so that the cylindrical valve head 150 has its working face 152 (FIG. 6) facing the working chamber 25 in cylinder assembly 12 and flush with the working face 34 of the cylinder head 32. Each rotary valve subassembly 145 also includes any elongate valve stem 154 (FIGS. 2, 6, 10 and 11) integral with that end of the cylindrical valve head 150 opposite the working face 152 with the valve stem 154 extending along the valve axis $A_V$ coaxially with the valve head 150. The valve stem diameter $d_{21}$ is smaller than the valve head diameter $d_{20}$ (FIG. 6).

An inwardly directed annular abutment 156 (FIG. 6) on the cylinder head 32 extends into the valve passage 151 just outboard of the valve head 150 on the valve 149 and a valve head bearing 158 (FIG. 6) is received in the outboard end of the valve passage 151 opposite the valve head 150 so that the valve stem 154 and thus the valve 149 is rotatably mounted in the valve passage 151. A snap ring 159 (FIG. 6) holds the valve head bearings 158 and the valve 149 in position in the valve passage 151 through the cylinder head 32 so that the valve 149 is axially fixed in the cylinder head 32 yet is rotatably mounted in the valve passage 151.

The valve stem 154 extends in clearance through an appropriate opening 160 (FIG. 4) in the alignment plate 110 of the alignment assembly 14 in the particular cylinder head assembly 31 associated with the valve 149. The opening 160 is sufficiently large to allow the valve stem 154 to freely rotate therein and the alignment plate 110 to reciprocate back and forth along the valve stem 154 without interference or bearing contact therewith.

The outboard end of the elongate valve stem 154 is provided with a first reduced cylindrical section 161 (FIG. 11) which defines a needle bearing race and also with a second reduced diameter cylindrical section 162 (FIG. 11) outboard of section 161 smaller in diameter than the first section 161 to form a thrust bearing shoulder 164 (FIG. 11) between sections 161 and 162 oriented normal to the valve axis $A_V$. Still referring to FIG. 11, it will be seen that the first and second reduced diameter sections 161 and 162 on the valve stem 154 project into a bearing passage 165 formed in an inwardly directed boss 166 on the support assembly 42 centered on the valve axis $A_V$. The bearing passage 165 has an enlarged section 168 in alignment with the first reduced diameter section 161 on the valve stem 154 and a smaller diameter section 169 in alignment with the second reduced diameter cylindrical section 162. Needle bearings 170 are rotatably mounted in the larger section 168 of the bearing passage 165 around the first reduced diameter cylindrical section 161 on the valve stem 154 so that the valve stem 154 is rotatably supported thereby in the bearing passage 165. Support ring 171 on the valve stem 154 keeps the needle bearings 170 in position. Thrust washers 172 are mounted in the smaller diameter section 169 of the bearing passage 165 about the second reduced diameter cylindrical section 162 on the valve stem 154 so that thrust washers 172 provide axial bearing support for the thrust bearing shoulder 164 as the gas pressures in the working chamber 25 urge the valve 149 axially outwardly along the valve axis $A_V$.

The valve head 150 defines a central passage 175 concentrically of the valve axis $A_V$ as best seen in FIG. 6 with the central passage 175 opening onto the working face 152 of the valve head 150 at the working chamber 25. The outboard end of the central passage 175 joins with an angularly oriented passage 176 centered along an appropriate axis $A_{10}$ so that the angularly oriented passage 176 exits through the side of the cylindrical valve head 150 intermediate its ends. It will also be noted from FIG. 13 that the angularly oriented passage axis $A_{10}$ is radially oriented with respect to the valve head 150 when viewed from the working face 152 as seen in FIG. 13 so that the passage 176 exits the valve head 150 at a specific circumferential position. As the valve 149 is axially rotated about the axis $A_V$, it will be seen that the angular passage 176 is rotated therewith.

Figure 5:
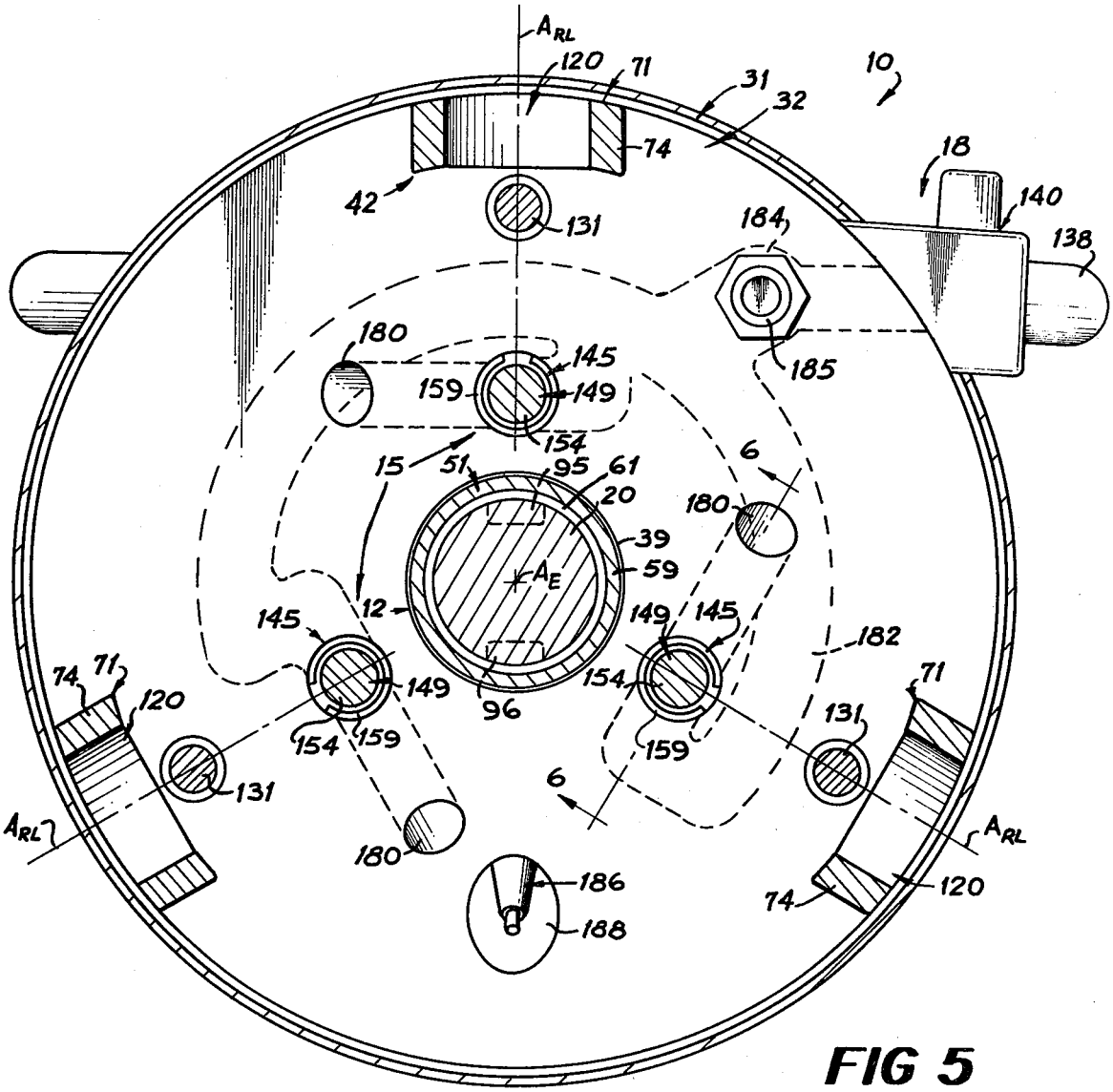
FIG. 5 is an enlarged transverse cross-sectional view taken generally along the line 5—5 in FIG. 2.

As seen in FIGS. 5 and 6, the cylinder head 32 is provided with an exhaust port 180 and an intake port 181 therein which open into a valve passage 151 so that the angularly oriented passage 176 in the valve head 150 moves successively into registration therewith as the valve head 150 rotates about the valve axis $A_V$. While the exhaust and intake ports 180 and 181 may be located at different angular positions, they are illustrated as being located at diametrically opposed positions around the valve passage 151 so that the valve head 150 must rotate about 180° between registration with the intake port 181 and the exhaust port 180. The relative diameters of the exhaust port 180 and intake port 181 are such that the working fluid is free to pass from the intake port 181 into the working chamber 25 through the angular passage 176 and the central passage 175 in valve head 150 while the exhaust gases are free to pass through the central passage 175 and the angular passage 176 out through the exhaust port 180. It will be seen that the exhaust port 180 is angularly located along an axis coaxially of the angular passage axis $A_{10}$ when the angular passage in the valve head is in registration with the exhaust port 180 so that the exhaust passage 180 exits the cylinder head 132 opposite the working face 34 thereof as seen in FIG. 6.

The intake ports 181 are connected to a common arcuate intake passage 182 (FIG. 5) defined in the cylinder head 32 so that the incoming intake air-fuel mixture will be distributed between the intake ports 181 at the different valve subassemblies 145. The arcuate intake passage 182 is connected to the crossover intake pipe 138 associated with the transfer chamber 132 of the supercharger assembly 16 opposite the cylinder head 32 in which the arcuate intake passage 182 is defined through an injection chamber 184 (FIG. 5) into which the fuel is injected to form the air-fuel mixture. An appropriate fuel injector 185 (FIGS. 1, 2 and 5) is mounted in the cylinder head 32 to inject fuel into the injection chamber 184 in known manner to form the air-fuel mixture.

Figure 11:
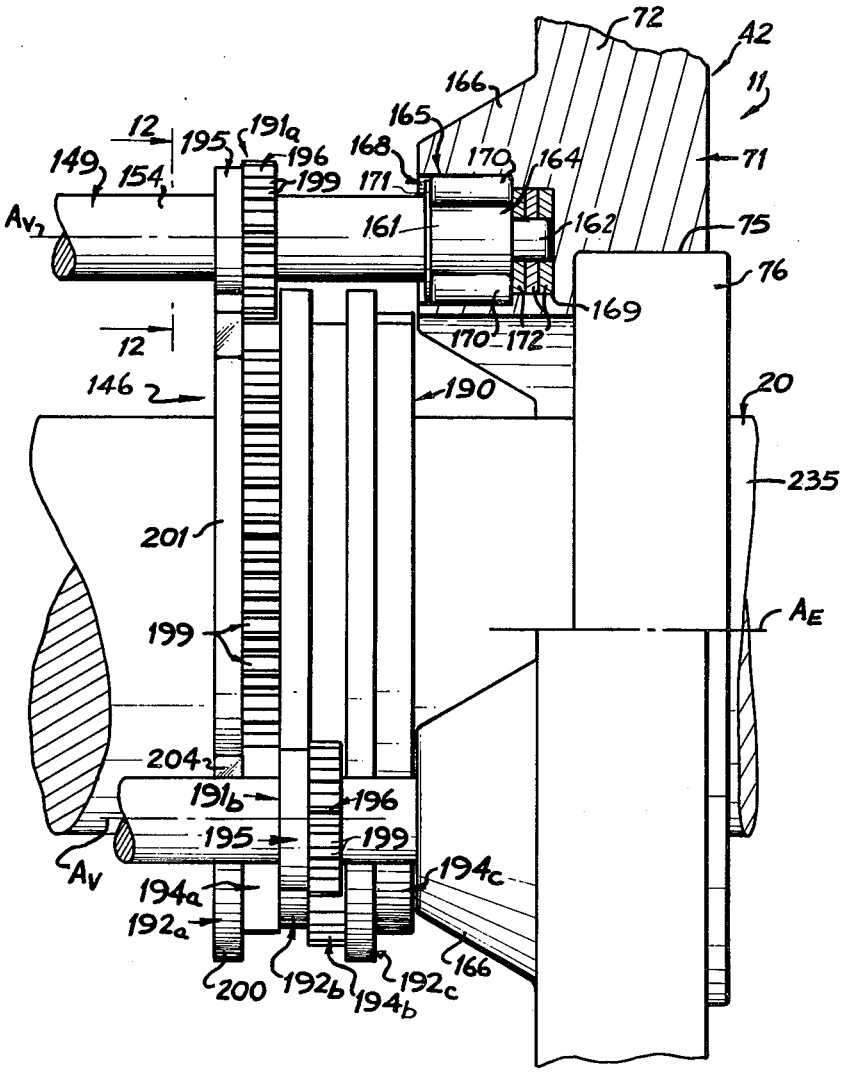
FIG. 11 is a side elevational view taken generally along the line 11—11 in FIG. 10.
Figure 12:
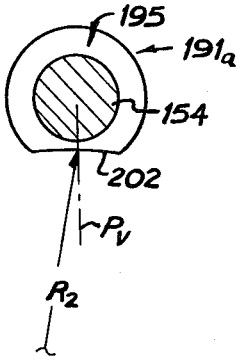
FIG. 12 is a cross-sectional view taken generally along line 12—12 in FIG. 11.

The common drive 146 which rotates the valves 149 about their axes $A_V$ is best seen in FIGS. 10–12 and includes a multiple gear/cam assembly 190 mounted on the drive shaft 20 adjacent the bosses 166 mounting the outboard ends of the valve stems 154. The multiple gear/cam assembly 190 rotates with the drive shaft 120. Each of the valves 149 is provided with a single gear/cam assembly 191 which rotates the valve 149 and is drivingly engaged by the multiple gear/cam assembly 190 on the drive shaft 20 to selectively rotate the valve 149 and cause the angular passage in the valve head 150 to sequentially and selectively come into registration with the intake and exhaust ports 181 and 180 as will become more apparent.

It will be seen that the multiple gear/cam assembly 190 includes a separate cam 192 and a separate gear sector 194 for each single gear/cam assembly 191 on each valve 149. For sake of clarity, the separate cams 192 and gear sectors 194 have been respectively numbered $192_a$-$192_c$ and $194_a194_c$ to identify the particular cam and gear sector with the particular single gear/cam assembly 191 on the valve with each of the single gear/cam assemblies 191 being specifically designated $191_a$-$191_c$. Thus, it will be seen that the gear/cam assemblies 191 on the valves 149 are axially displaced along the engine axis $A_E$ with respect to each other while the cam 192 and the gear sector 194 associated with each gear/cam assembly 191 is also axially shifted along the drive shaft 20 so that the particular cam $192_a$-$192c$ and the gear sector $194_a$-$194_c$ is in registration with the particular single gear/cam assembly $191_a$-$191_c$. The multiple gear/cam assembly 190 on the drive shaft 20 and the single gear/cam assemblies 191 on the valves 149 are so designed that the valves 149 will be rotated through both their intake and exhaust positions while the piston 50 on the piston assembly 12 moves through a small portion of its stroke in order that the exhaust gases can be discharged from the particular working subchamber 25*a* or 25*b* associated with the valves 149 in that particular valve assembly 15 and the new air-fuel mixture can be injected into the working subchamber 25*a* or 25*b* in order for the working subchamber to be recharged for operating of the engine.

Because the particular cam 192 and gear sector 194 associated with each of the single gear/cam assemblies 191 is functionally the same with respect to the single gear/cam assemblies 191, only the operation of the cam $\mathbf{192}_a$ and the gear sector $\mathbf{194}_a$ together with the single gear/cam assembly $\mathbf{191}_a$ will be described in detail, it being understood that a like functional operation will be associated with each of the other cams $\mathbf{192}_b$ and $\mathbf{192}_c$, the gear sectors 194*b* and $\mathbf{194}_c$, and the single gear/cam assemblies $\mathbf{191}_b$ and $\mathbf{191}_c$.

Still referring to FIGS. 10–12, each of the single gear/cam assemblies 191 includes a locking cam 195 and a driven spur gear 196. The locking cam 195 engages the cam $\mathbf{192}_a$ on the multiple gear/cam assembly 190 while the driven spur gear 196 is drivingly engaged by the gear sector $\mathbf{194}_a$ on the multiple gear/cam assembly 190 to selectively rotate the valve 149.

It will be appreciated that the drive shaft 20 and thus the multiple gear/cam assembly 190 will be rotated 180° during each stroke of the piston 50 so that the drive shaft 20 rotates one-half revolution as the piston moves in one direction along the engine axis $A_E$ and then rotates another one-half revolution in the same direction as the piston 50 moves in the opposite direction on the engine axis $A_E$. It will also be noted that the driven spur gear 196 on the single gear/cam assembly $\mathbf{191}_a$ has teeth 198 (FIG. 10) completely around the circumference thereof with an effective pitch diameter $d_{22}$ while the gear sector $\mathbf{194}_a$ on the gear/cam assembly 190 has teeth 199 thereon which extend through circumferential angle $A_{11}$ with the teeth 199 having a pitch diameter $d_{24}$. The center to center distance between the valve stems 154 and the drive shaft 20 is $d_{25}$ (FIG. 10) which is equal to one-half the sum of the pitch diameters $d_{22}$ and $d_{24}$ so that the teeth 199 on the gear sector 194 will mesh with the teeth 198 around the driven spur gear 196 on single gear/cam assembly $\mathbf{191}_a$ as the multiple gear/cam assembly 190 is rotated thereby. The teeth 199 on the gear sector 194 start at a specific circumferential position $P_a$ (FIG. 5). With the piston 50 at about in the position illustrated in FIG. 2, the position $P_a$ is angularly shifted from the axis $A_V$ of the single gear/cam assembly $\mathbf{191}_a$ by the angle $A_{12}$. This angular shift $A_{12}$ determines the timing of the valve with respect to the piston movement and may appropriately vary from engine to engine depending on the size and stroke of the piston 50 and the size of the working subchambers 25*a* and 25*b*. The angular length $A_{11}$ of the teeth 199 on the gear sector $\mathbf{194}_a$ is such that the teeth 199 will rotate the driven spur gear 196 on the single gear/cam assembly $\mathbf{191}_a$ through 360° as the teeth 199 are rotated past the spur gear 196.

It will be appreciated that FIGS. 10–13 are directed to the valve assembly 15 associated with the right hand working subchamber 25*a* as seen in FIG. 2. The cam $\mathbf{192}_a$ on the multiple gear/cam assembly 190 and the locking cam 195 on the single gear/cam assembly $\mathbf{191}_a$ serve to keep the single gear/cam assembly $\mathbf{191}_a$ in proper registration while preventing the rotation thereof until the spur gear 196 is engaged by the teeth 199 on the gear sector $\mathbf{194}_a$. Thus, the cam $\mathbf{192}_a$ has a circular camming surface 200 (FIG. 10) with a diameter $d_{26}$ which is greater than the pitch diameter $d_{24}$ of the teeth 199 on the gear sector $\mathbf{194}_a$.

The cam $\mathbf{192}_a$ further defines a cutout 201 therein in registration with the sector gear teeth 199 on the gear sector $\mathbf{194}_a$ so that an interruption in the cam surface 200 is provided in registration with the teeth 199 whereby the teeth 199 can drive the spur gear 196 on the single gear/cam assembly $\mathbf{191}_a$. It will also be appreciated that the cutout 201 is longer than the toothed section on the gear sector $\mathbf{194}_a$ and has a length such that the cutout 201 starts at the leading end of the teeth 199 at a position angularly displaced forwardly of the leadingmost tooth 199 on the gear sector $\mathbf{194}_a$ by the angular distance $A_{14}$ (FIG. 10). This angular shift $A_{14}$ will become more apparent. Likewise, the cutout 201 extends past the trailingmost tooth 199 on gear sector $\mathbf{194}_a$ by the angular distance $A_{15}$ (FIG. 10) as will become more apparent.

The locking cam 195 on the gear/cam assembly $\mathbf{191}_a$ has a diameter $d_{28}$ (FIGS. 10 and 12) such that one-half the sum of the diameters $d_{26}$ and $d_{28}$ is greater than the center to center distance $d_{25}$ between the drive shaft 20 and the valve axis $A_V$ so that the locking cam 195 on the gear/cam assembly $\mathbf{191}_a$ would normally interfere with the cam surface 200 on the cam 192 of the gear/cam assembly 190. An arcuate cutout 202 (FIGS. 10 and 12) is defined in the locking cam 195 with an effective radius $R_2$ which is equal to one-half the diameter $d_{26}$ of the camming surface 200 on cam $\mathbf{192}_a$. The arcuate cutout 202 in the locking cam 195 on the single gear/cam assembly $\mathbf{191}_a$ is located so that the cam surface 200 on the cam $\mathbf{192}_a$ can rotate past the arcuate cutout 202 and thus maintain the relative rotational position of the valve 149 fixed on the position seen in FIG. 10 as long as the cam surface 200 is within the arcuate cutout 202 in the locking cam 195. Thus, it will be seen that the arcuate cutout 202 is centered on a diametrically extending path $P_V$ (FIGS. 10, 12 and 13) normal to the valve axis $A_V$ in angular registration with the axis $A_{10}$ of the angularly oriented passage 176 in the valve head 150.

Referring to FIG. 10, when the cam surface 200 on cam $\mathbf{192}_a$ passes out of the arcuate cutout 202 so that the cutout 201 in the cam $\mathbf{192}_a$ is in registration with the locking cam 195 on the single gear/cam assembly $\mathbf{191}_a$, the locking cam 195 is free to rotate along with the valve 149. The angular shift $A_{14}$ between the leadingmost tooth 199 on the gear sector 194 and the leading end of the cutout 201 is sufficient to allow the cam surface 200 to clear the arcuate cutout 202 in the locking cam 195 prior to engagement of the teeth 199 on the gear sector $\mathbf{194}_a$ with the teeth 198 on the driven spur gear 196. Thus, as soon as the cam surface 200 on the cam $\mathbf{192}_a$ clears the arcuate cutout 202 in the locking cam 195 on the single gear/cam assembly $\mathbf{191}_a$, the teeth 199 on the gear sector $\mathbf{194}_a$ engage the teeth 198 on the driven spur gear 196 and drive the single gear/cam assembly $\mathbf{191}_a$ and thus the valve 149 so that the angularly oriented passage 176 in the valve head 150 rotates first past the exhaust port 18 to permit the exhaust gases in the working subchamber 25*a* to flow out of the working subchamber 25*a* through the passages 175 and 176 in the valve head 150 and then out through the exhaust port 180 to the exhaust manifold assembly 19. As the teeth 199 on gear sector $\mathbf{19}_a$ continue to rotate the driven spur gear 196 on the single gear/cam assembly $191_a$, the angularly oriented passage 176 in the valve head 150 continues to rotate until the exhaust port 180 is blocked and the angularly oriented passage 176 starts to come into registration with the intake port 181 in the cylinder head 32. When this occurs, the pressurized air-fuel mixture from the arcuate intake passage 182 flows into the working subchamber 25a through the intake port 181 and the passages 175 and 176 in the valve head 150. The teeth 199 continue to rotate the driven spur gear 196 so that the angularly oriented passage 176 in the valve head 150 rotates out of registration with the intake port 181 and moves back to its initial position seen in FIG. 3. When this occurs, the teeth 199 on the gear sector $194_a$ disengage the teeth 198 on the driven spur gear 196 on the single gear/cam assembly $191_a$ so that the valve 149 is no longer rotationally driven. The angular shift between the trailing tooth 199 on the gear sector $194_a$ and the trailing end of the cutout 201 in the cam $192_a$ is such that the trailing-most tooth 199 on the gear sector $194_a$ just clears the teeth 198 on the single gear/cam assembly $191_a$ before the locking cam 195 on the single gear/cam assembly $191_a$ is engaged by the angular locating surface 204 (FIG. 10) connecting the cutout 201 with the same surface 200. Any over or under rotation of the arcuate cutout 202 in the locking cam 195 is adjusted by this angularly oriented locating surface 204 so that registration between the arcuate cutout 202 in the locking cam 195 and the cam surface 200 in the cam $192_a$ is insured.

Spark plugs 186 (FIGS. 2 and 14) are provided for each combustion subchamber 25a and 25b. For sake of simplicity, only spark plug 186 for combustion chamber 25b is illustrated in FIG. 2 with spark plug 186 for combustion subchamber 25a seen in FIGS. 4 and 5. A threaded spark plug passage 188 (FIGS. 2 and 14) is provided in cylinder head 32 to place spark plug 186 in communication with its respective combustion subchamber 25a or 25b.

EXHAUST MANIFOLD ASSEMBLIES

As best seen in FIG. 1, each exhaust manifold assembly 19 includes a plurality of exhaust header pipes 205 which extend from the outboard opening of each exhaust port 180 to an arcuate exhaust manifold 206. Thus, each end of the working chamber 25 has one of the exhaust manifold assemblies 19 associated therewith. The two arcuate exhaust manifolds 206 are connected to a common exhaust 208 through a Y-connection 209 also seen in FIG. 1.

LUBRICATION ASSEMBLY

Figure 14:
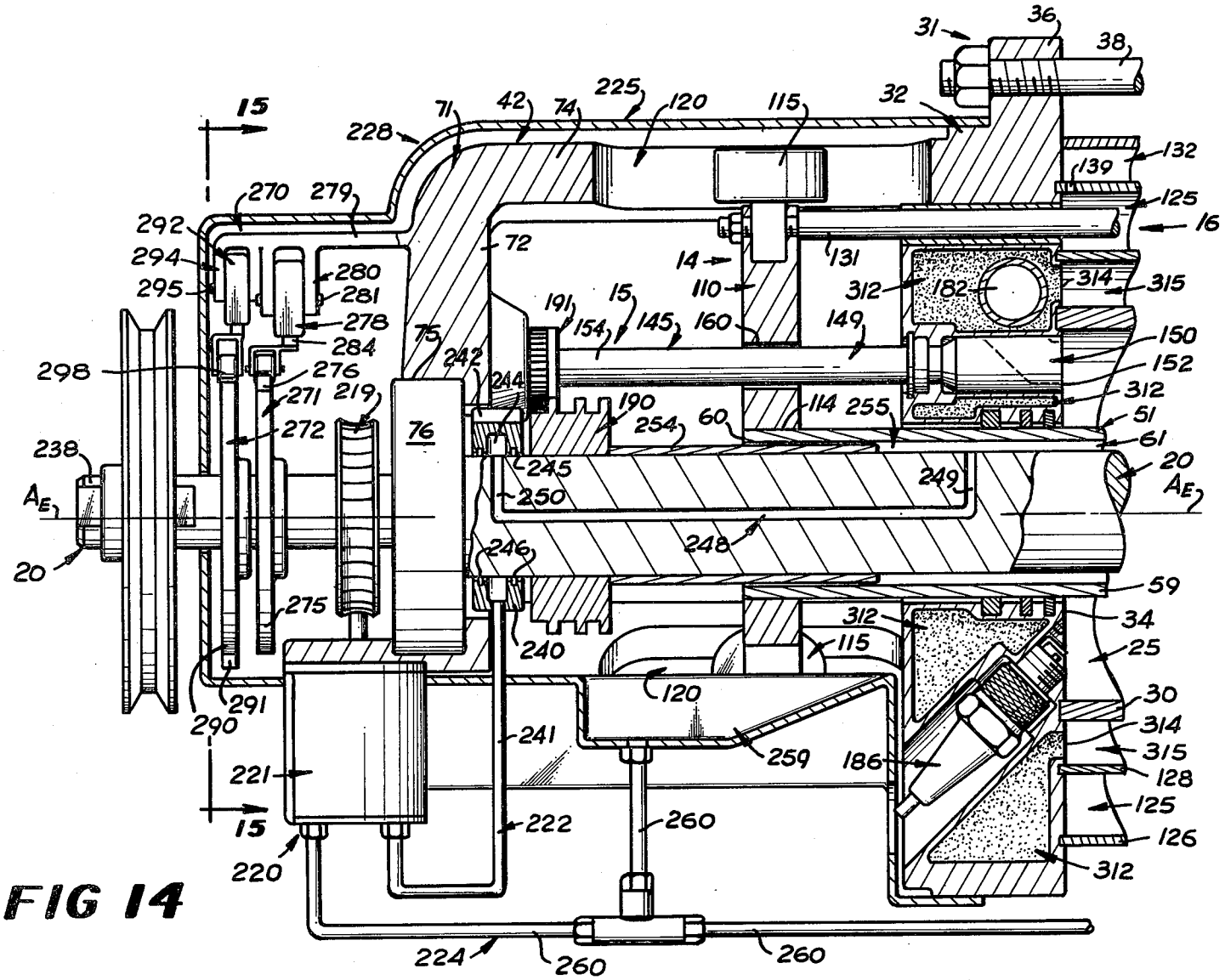
FIG. 14 is an enlarged cross-sectional view taken along line 14—14 in FIG. 3 but at the opposite end of the engine.

A lubrication assembly 220 is provided for lubricating the various components of the engine 10 best seen in FIGS. 1, 2, 8, 11 and 14. The lubrication assembly 220 includes generally an oil pump 221 (FIGS. 1 and 14) operatively connected to a distribution system 222 (FIGS. 1, 2, 8, 11 and 14) and a return system 224 (FIGS. 1, 2 and 14). The oil pump 221 is directly driven from the drive shaft 20 by a conventional worm drive 219 (FIG. 14). The low pressure inlet side of the pump 221 is connected to the return system 224 while the distribution system 222 is connected to the high pressure outlet side of the pump 221.

The return system 224 is incorporated in the cylinder head assembly covers 225 and 226 best seen in FIGS. 1 and 2. The covers 225 and 226 have basically the same configuration with cover 225 associated with the near end 228 of engine 10 in FIG. 1 while cover 226 is associated with the distal end 229 of engine 10 in FIG. 1. From FIGS. 1 and 2, it will be seen that the near end 228 is opposite the output end of drive shaft 20 with the distal end 229 being at the output end of drive shaft 20. Thus, drive shaft 20 has an output end 235 (FIG. 2) mounting and output connector 236 while the opposite end 238 of shaft 20 serves as the accessory drive as will become more apparent. The covers 225 and 226 enclose the support assemblies 42 on the cylinder head assemblies 31. Connector 236 may mount a flywheel as shown.

As best seen in FIG. 14, the distribution system 222 includes an oil distribution ring 240 mounted about the drive shaft 220 inboard of the support bearing 76 located at the accessory drive end 238 of the drive shaft 20 and outboard of the multiple gear/cam assembly 190 adjacent the accessory drive end 238 of the drive shaft 20. The high pressure output side of the oil pump 221 is connected to the oil distribution ring 240 via a high pressure rubing 241 (FIG. 14). It will be noted that the oil distribution ring 240 does not rotate with the drive shaft 20, but rather is keyed to the support assembly 42 at that end of the drive shaft 20 as indicated at 242. It will further be noted that the oil distribution ring 240 defines an annular oil distribution chamber 244 about the drive shaft 20 and also defines a passage 245 therethrough through which the drive shaft 20 extends. The oil distribution chamber 244 is sealed to the shaft 20 via sealing rings 246 so that the high pressure oil from the oil pump 221 is fed into the oil distribution chamber 244 via the high pressure tubing 241 connecting the oil pump 221 to the ring 240. It will further be noted that the drive shaft 20 defines an oil passage 248 (FIG. 14) therein whose inlet end 250 opens onto the exterior surface of the drive shaft 40 in registration with oil distribution chamber 244 so that the oil in the oil distribution chamber 244 can pass along the oil passage 248 in the drive shaft 20 and exit into the oil distribution space 255 (FIGS. 8 and 14) between the drive shaft 20 and the reciprocating support tube 51 in the vicinity of the cylinder head 32 associated with the accessory drive end 238 of the drive shaft 20. The exit end 249 of the oil passage 248 is seen in FIG. 14.

The oil distribution system 222 also includes a pair of oil check bushings 254 (FIG. 14) mounted on the drive shaft 20 inboard of the multiple gear/cam assemblies 190 at opposite ends of the engine 10. The bushings 254 extend between the drive shaft 20 and the inside of the support tube 51 so that the oil check bushings 254 just provide running clearance with the support tube 51 as will become more apparent. The oil check bushings 254 are fixedly mounted on the drive shaft 20 and rotate therewith. The oil check bushings 254 serve to restrict the flow of oil passing into the oil distribution space 255 between the drive shaft 20 and the support tube 51 so that the oil distribution space 255 will remain filled with oil from the oil passing out of the exit end 249 of oil passage 248 in the drive shaft 20 from the oil distribution ring 240. The oil check bushings 254 have a length sufficient that the oil check bushings 254 always substantially close the outboard ends 60 of the support tube 51 regardless of the position of the piston assembly 12 along the length of the stroke.

To force the oil from within the oil distribution space 255 between the drive shaft 20 and the support tube 51, and oil diverting ring 258 (FIG. 8) is mounted inside the support tube 51 so that it lies in a plane normal to the engine axis $A_E$ and is positioned between the cam pins 81 in the pistons 50 as best seen in FIG. 8. The oil diverting ring 258 serves to divert the oil flowing through the oil distribution space 255 outwardly around the cam pin 81 in cam assembly 22 to the needle bearings 86 and the thrust washers 88 to lubricate them. This also causes the oil, because it is generally flowing from the left hand end of the engine 10 toward the right hand end of the engine as seen in FIG. 8, to primarily flow outwardly along the cam assembly 22 so that it passes to the outside of the piston 50 between the sealing rings 56, to then flow around the piston 50 between the sealing rings 56, to then flow back into the oil distribution space 255 through the camming assembly 21, and to then flow out through the clearance space 255 between the oil check bushing 254 and the support tube 51 associated with the output end 235 of the drive shaft 20. As the oil flows back in through cam assembly 21, the thrust washers 88 and needle bearings 86 are lubricated. It will be appreciated that some of the oil may continue to flow along the oil distribution space 255 past oil diverting ring 258 since the oil can flow in the cam slots 95 and 96 under the oil diverting ring 258. A sufficient amount of the oil will be diverted out through the cam assembly 22 and back in through the cam assembly 21 by ring 258 and centrifugal force to keep the cylinder side wall 30 as well as the camming assemblies 21 and 22 lubricated.

The oil flowing out through the clearances between the oil check bushings 254 and the support tube 51 drop into appropriate oil sumps 259 in the oil return system 224. The oil sumps 259 are formed in the covers 225 and 226 under the outboard ends of the support tube 51 as seen in FIG. 14. The oil caught in sumps 259 are connected back to the low pressure inlet side of the oil pump 221 via return tubing 260 of the return system 224 as seen in FIGS. 1, 2 and 14.

A convenient means (not shown) is provided for keeping the alignment assemblies 14 and the valve assemblies 15 lubricated. While any number of mechanisms are available for this purpose, one such mechanism which may be used is an oil spray.

INTAKE AND FIRING CONTROL SYSTEM

The intake and firing control system 270 is illustrated in FIGS. 1 and 14–16. The intake and firing control system 270 serves to control both the intake air-fuel mixture being injected into the combustion subchambers 25*a* and 25*b* via the supercharger assembly 16 and the fuel injectors 185 as well as the firing of the spark plugs 186 to ignite the air-fuel mixture in the combustion subchambers 25*a* and 25*b*. The intake and firing control system 270 includes an intake control cam assembly 271, a firing control cam assembly 272, and an electronic engine controller 274.

The intake control cam assembly 271 (FIGS. 14 and 15) includes an intake control cam 275 mounted on the accessory drive end 238 of drive shaft 20 and rotatable therewith. The cam 275 defines a pair of diametrically opposed intake camming tabs 276 thereon with one of the camming tabs 276 being operatively associated with the combustion subchamber 25*a* and the other camming tab 276 being operatively associated with the combustion subchamber 25*b*. An intake timing switch 278 is associated with the intake control cam 275 so that the camming tabs 276 activate the intake timing switch 278 as the tabs 276 are rotated thereby as the drive shaft 20 rotates.

The intake timing switch 278 is movably mounted on a common switch mount 279 (FIGS. 14 and 15) carried by the support assembly 42 on that cylinder head assembly 31 associated with the accessory drive end 238 of the drive shaft 20. Any number of mechanism may be used to movably mount the intake timing switch 278 on the common switch mount 279. The particular intake timing switch mounting mechanism 280 movably mounting the intake timing switch 278 on the common switch mount 279 is illustrated in FIGS. 14 and 15 as pins 281 on opposite sides of the intake timing switch 278 which are slidably mounted in arcuate slots 282 defined in the common switch mount 279 as best seen in FIG. 15 with the arcuate slots having a radius of curvature whose axis coincides with the engine axis $A_E$ so that the intake timing switch actuator arm 284 is always maintained in operative spacing with the intake camming tabs 276 as the intake timing switch 278 is shifted along the arcuate slots 282. The intake timing switch 278 is positioned along the arcuate slots 282 by an intake timing switch positioner 285, best seen in FIG. 15 as being mounted on the cover 225. The intake timing switch positioner 285 appropriately positions the intake timing switch 278 so that the fuel will be appropriately injected into the intake air from the supercharger assembly 16 via the fuel injectors 185.

The firing control cam assembly 272 (FIGS. 14 and 15) includes a firing control cam 290 also mounted on the accessory drive end 238 of drive shaft 20 and rotatable therewith. The cam 290 defines a pair of diametrically opposed firing camming tabs 291 thereon with one of the camming tabs 291 being operatively associated with the combustion subchamber 25*a* and the other camming tab 291 being operatively associated with the combustion chamber 25*b*. A firing timing switch 292 is associated with the intake control cam 290 so that the camming tabs 291 activate the firing timing switch 292 as the tabs 291 are rotated thereby as the drive shaft 20 rotates.

The firing timing switch 278 is also movably mounted on the common switch mount 279 carried by the support assembly 42 on that cylinder head assembly 31 associated with the accessory drive end 238 of the drive shaft 220. The firing timing switch mounting mechanism 294 movably mounting the firing timing switch 292 on the common switch mount 279 is illustrated as pins 294 on opposite sides of the firing timing switch 292 which are slidably mounted in arcuate slots 296 defined in the common switch mount 279 as best seen in FIG. 15 with the arcuate slots having a radius of curvature whose axis coincides with the engine axis $A_E$ so that the firing timing switch actuator arm 298 always is maintained in operative spacing with the firing camming tabs 291 as the firing timing switch 292 is shifted along the arcuate slots 296. The firing timing switch 292 is positioned along the arcuate slots 296 by a firing timing switch positioner 299, best seen in FIG. 15 as being mounted on the cover 225. The firing timing switch positioner 299 appropriately positions the firing timing switch 292 so that the spark plugs 186 will be appropriately fired to ignite the air-fuel mixture in combustion subchambers 25*a* and 25*b* as will become more apparent.

The electronic engine controller 274 is schematically seen in FIG. 16, and includes an intake control section 300 and a fire control section 301. Because the mechanisms necessary to functionally control the intake air-fuel mixture of the engine 10 and the firing of the engine are conventionally available, the intake control section 300 and the fire control section 301 will only be functionally described, it being understood that any number of such sections are available and within the scope of one skilled in the art to provide, especially those control mechanisms using integrated circuit designs.

The intake control section 300 (FIG. 16) serves to control the amount of air being introduced into the combustion subchambers 25*a* and 25*b* of the engine while at the same time controlling the amount and timing of the fuel injection into the intake air from the supercharger assembly 16. The intake timing switch 278 is connected to one of the inputs of the intake control section 300. Additional external control inputs labelled on FIg. 16 are also provided to the intake control section 300. These external control inputs may include engine speed, engine load, accelerator position and other appropriate external inputs normally associated with internal combustion engine operation.

One output $O_1$ from the intake control section 300 is connected to the intake timing switch positioner 285 to selectively control the position of the intake timing switch 278 along the intake switch mounting mechanism 280 so as to control the timing of the fuel being injected into the intake air as will become more apparent. A pair of intake air volumetric control outputs $O_{2A}$ and $O_{2B}$ are also provided from the intake control section 300 and are connected to the pressure regulator valves 140 (FIGS. 1 and 5) so that the amount of intake air from the supercharger assembly 16 into each of the combustion subchambers 25*a* and 25*b* can be selectively controlled. This is done by the intake control section 300 setting the pressure in each of the transfer chambers 132 so that the total amount of air injected into the combustion chamber 25*a* or 25*b* when the valves 149 connect the transfer chamber 132 to the combustion subchamber 24*a* ro 25*b* is controlled. Thus, it will be seen that the higher the pressure maintained in the transfer chamber 132 by valves 140, the greater the amount of air that will be injected into the combustion subchamber 25*a* or 25*b*. The intake control section 300 also includes a pair of injector control outputs $O_{3A}$ and $O_{3B}$ which are connected to the fuel injectors 185 at opposite ends of the engine. These outputs serve to control the timing of the fuel injection into the intake air as it is being injected into the combustion subchambers 25*a* and 25*b* in the engine from transfer chambers 132. The intake control section 300 also has a fuel quantity control output $O_4$ connected to a fuel flow regulator valve 302 schematically shown in FIG. 16 which controls the quantity of fuel flowing to the injectors 185 so as to selectively regulate the amount of fuel injected into the intake air each time each fuel injector 185 is actuated. Thus, it will be seen that each time the intake control section 300 increases the amount of air being forced into the combustion subchambers 25*a* or 25*b*, the fuel flow regulator valve 302 will be appropriately adjusted to increase the amount of fuel being injected into the intake air through the fuel injectors 185 so as to maintain the correct air-fuel ratio in the combustible mixture being injected into the combustion subchambers 25*a* and 25*b*.

The fire control section 301 (FIG. 16) of the engine controller 274 has one of its inputs connected to the firing timing switch 292 so that the firing control camming tabs 291 control the firing of the spark plugs 186 mounted in each of the cylinder heads 32 in communication with the combustible mixture in the subchambers 25*a* and 25*b*. One of the outputs $O_{10}$ of the fire control section 301 is connected to the firing switch positioner 299 so that the fire control section 301 appropriately adjusts the timing of the firing of the spark plugs 186 to insure proper firing of the combustible air-fuel mixture in the working subchambers 25*a* and 25*b*. External control inputs are also schematically illustrated in FIG. 16 to the fire control section 301 to appropriately shift the firing timing switch 292 to achieve proper operation of the engine 10. The fire control section 301 also has a pair of outputs $O_{11A}$ and $O_{11B}$ connected to the spark plugs 186 so that the fire control section 301 causes the spark plugs 186 to fire at the proper time to operate the engine.

As best seen in FIGS. 1 and 2, an appropriate accessory drive 316 may be attached to the accessory drive end 238 of drive shaft 20 outboard of the near cover 225. Drive 316 may be any number of mechanisms and is illustrated as a V-belt pulley. It is understood, however, that different mechanisms may be substituted for pulley 316 without departing from the scope of the invention.

COOLING SYSTEM

A cooling system is provided for maintaining the temperature of the engine 10 while it is operating. As best seen in FIG. 1, one of the cylinder head assemblies 31 is provided with a coolant inlet 310 through which the coolant is introduced into the engine while the other cylinder head assembly 31 is provided with a coolant outlet 311 from which the coolant is returned to an external cooling source such as a radiator (not shown). Thus, it will be seen that the coolant enters through the inlet 310, passes through the engine 10 and then exits through the outlet 311.

As best seen in FIG. 14, each of the cylinder heads 32 is provided with appropriate internal coolant passages 312 so that the coolant can circulate about the cylinder head 32 to cool same. These coolant passages 312 are so constructed that they communicate with the coolant inlet 310 on that cylinder head 32 associated with the coolant inlet 310 while those coolant passages 312 in that cylinder head 32 associated the coolant outlet 311 communicate with outlet 311.

It will be noted that the interior side wall 128 of the supercharger assembly 16 and the cylinder side wall 30 of the cylinder assembly 11 define an annular cooling chamber 315 therebetween which extends between the cylinder heads 32. This allows the coolant to pass around the exterior of the cylinder side wall 30 to cool the combustion chamber 25 in the cylinder assembly 11 while at the same time heating the incoming air in the supercharger chamber 125. To insure that the coolant passes along the cooling chamber 315, each of the cylinder heads 32 is provided with transfer ports 314 which connect the cooling chamber 315 with the coolant passages 312 in the cylinder head assembly 32. Thus, the coolant passes into the coolant passages 312 in that cylinder head 32 containing the coolant inlet 310, passes therefrom through the transfer ports 314 therein into the cooling chamber 315 in between the side walls 130 and 128, passes into the coolant passages 312 in the opposite cylinder head 32 through the transfer ports 314 therein, and subsequently passes out of the cylinder head 32 containing the coolant outlet 311. In this manner, positive cooling is provided for the combustion chamber 25 while positive heating of the incoming fresh air and the supercharger chamber 125 is also provided.

MODIFIED CAMMING ASSEMBLIES

Figure 18:
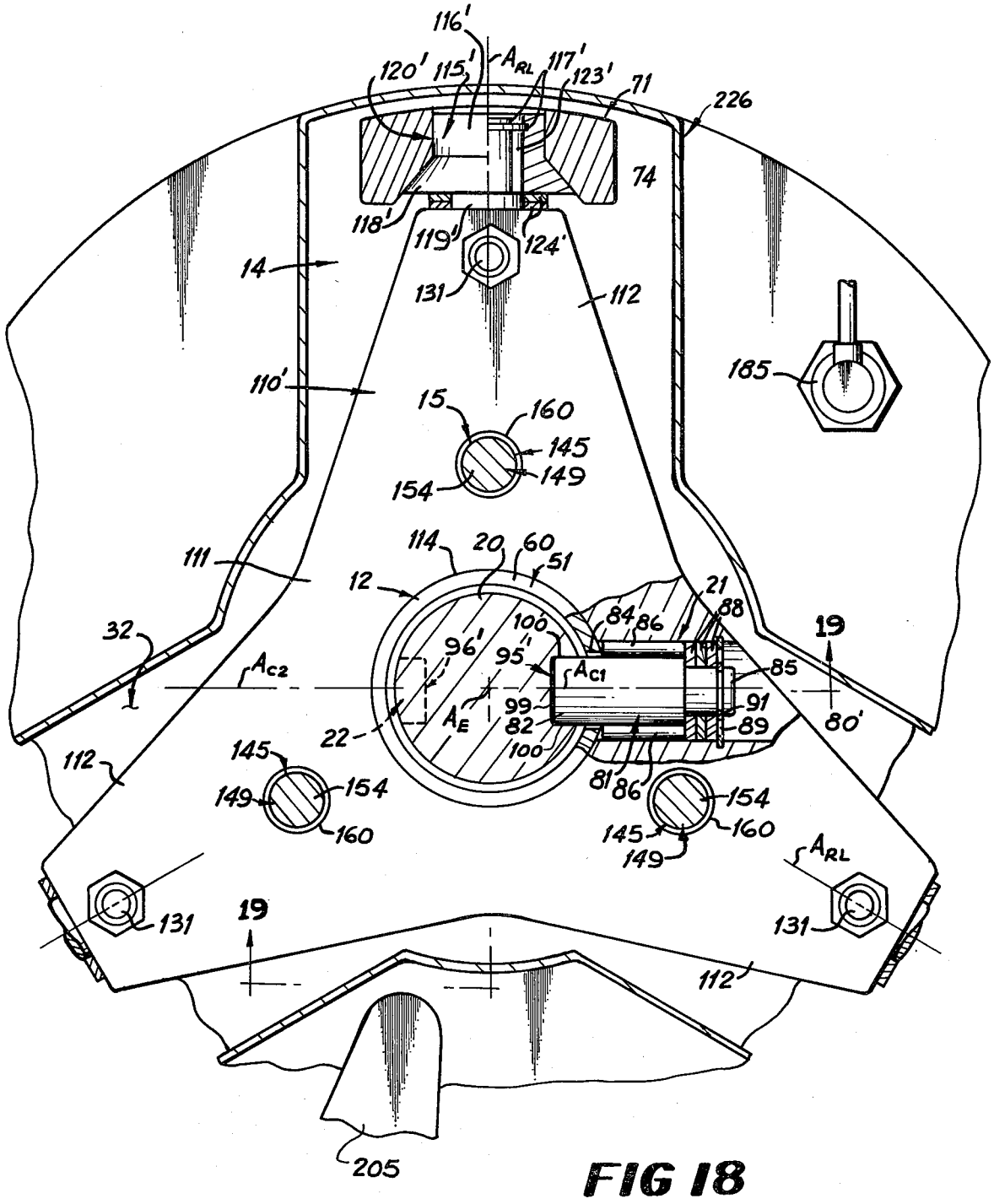
FIG. 18 is a view similar to FIG. 4 showing a modification of the invention.
Figure 19:
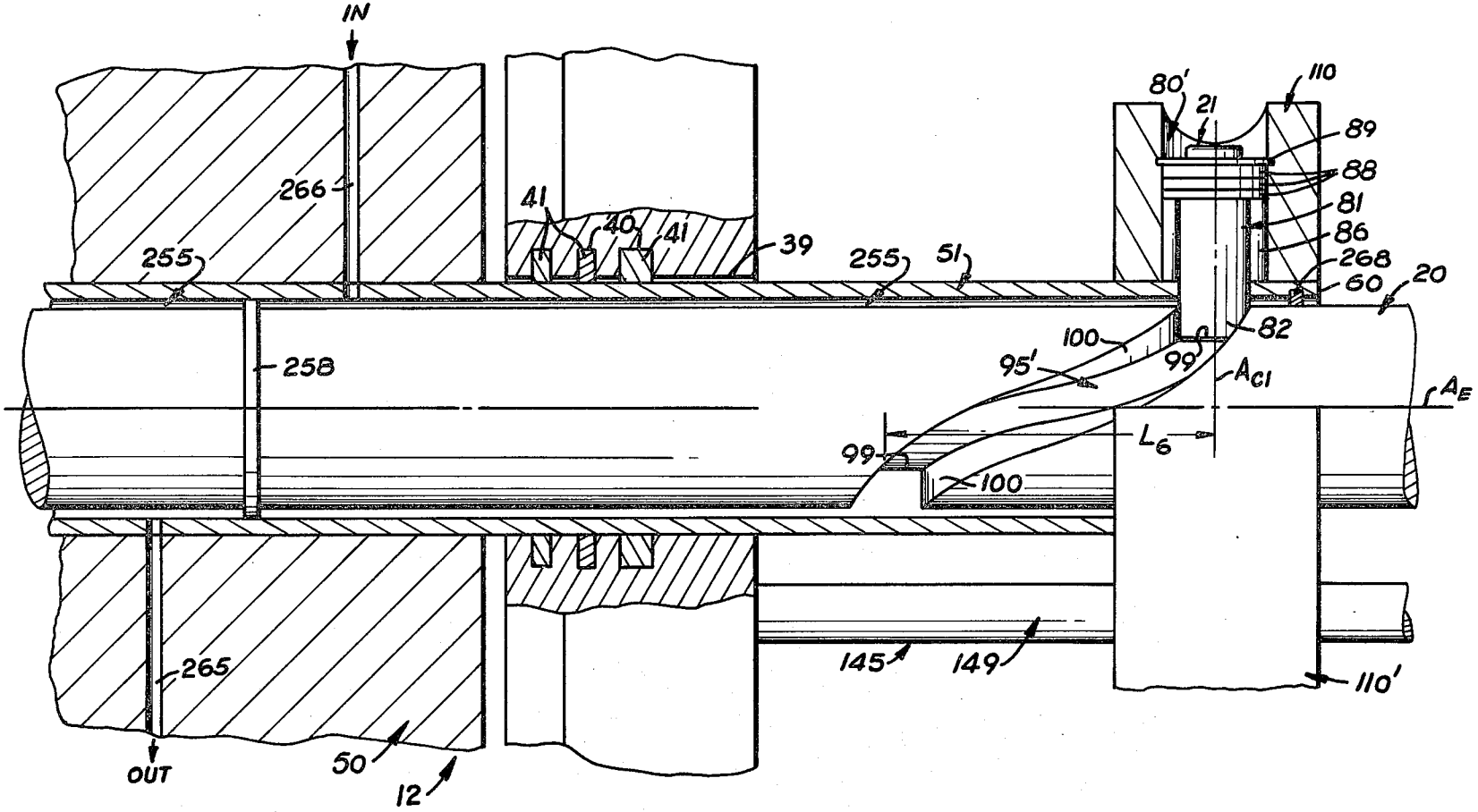
FIG. 19 is a view taken along line 19—19 in FIG. 18.

Alternatively to mounting the camming assemblies 21 and 22 in the piston 50, it will be appreciated that the camming assemblies 21 and 22 may be mounted in the alignment assemblies 14 as illustrated in FIGS. 18 and 19. FIG. 18 corresponds generally to FIG. 4 except that the camming assemblies 21 and 22 have been axially shifted sufficiently far apart to be placed in the alignment assemblies 14. It will be appreciated that the camming assembly 21 is located in one of the alignment assemblies 14 while the camming assembly 22 is located in the opposite camming assembly 14. It will further be appreciated that each alignment assembly 14 may include a camming assembly 21 and a camming assembly 22 if that is desired. Only camming assembly 21 is illustrated in detail in FIGS. 18 and 19 with it being understood that the camming assembly 22 would be located in the alignment assembly 14 at the opposite end of the engine and arranged so that it is preferably diametrically opposed to the camming assembly 21 illustrated.

Turning now to FIGS. 18 and 19, it will be seen that the camming assembly 21 is the same as the camming assembly 21 described hereinbefore and thus has like reference numbers applied thereto. The radially extending cylindrical passage 80' is shown located in alignment plate 110' rather than in the piston 50. The operation of the camming assembly 21 is the same as that previously described and will not be repeated. It will also be appreciated that an endless cyclodial cam slot 95' is associated with the camming assembly 21 while a similar slot 96' is associated with the camming assembly 22 as seen by dashed lines in FIG. 18 with it being understood that the cam slot 96' and the camming assembly 22 would be associated with the alignment plate 110' opposite the alignment plate 110 shown in FIGS. 18 and 19. The endless cyclodial cam slot 95' has the same shape as the cam slot 95' already described. However, because the cam slots 95' and 96' are axially shifted with respect to each other along the drive shaft 20 sufficiently to place them in registration with the camming assemblies 21 and 22 respectively in the alignment plates 110', the cam slots 95' and 96' do not intersect as described with the cam slots 95 and 96. The cam slots 95' and 96' have the same configuration and relative dimensions as the cam slots 95 and 96 and thus have the same reference numbers applied thereto.

One of the advantages of placing the cam assemblies 21 and 22 in the alignment plates 110' is that the torque applied to the support tube 51 when the camming assemblies 21 and 22 are mounted in the piston 50 will be transferred directly to the camming assemblies 21 and 22 in the alignment plates 110' with that modification seen in FIGS. 18 and 19 to minimize the torsional forces applied to the support tube 51.

The alignment rollers carried on the alignment plates 110' may be the same as that seen in FIG. 4. However, the alignment rollers 115' illustrated in FIG. 18 have been modified to positively maintain the end 60 of the piston support tube 51 concentric of the engine axis $A_E$ and offset the additional side loading exerted on the piston support tube 51 by the camming assemblies 21 and 22 located in the alignment plates 110'.

In FIG. 18, it will be seen that each alignment roller 115' has a cylindrical surface section 116' at its outboard end which joins with a frusto-conical surface section 118' at its inboard end with both surface sections 116' and 118' rotatable about the roller axis $A_{RL}$ on stub shaft 119'. The elongate slot 120' is shaped complementarily to the surface sections 116' and 118' defining spaced apart side surface sections 121' along which surface section 116' on roller 115' rolls and spaced apart angled surface sections 122' along which the frusto-conical surface section 118' on roller 115' rolls.

Roller 115' is rotatably journalled on stub shaft 119' by needle bearings 123' journalled against axial thrust by thrust washers 124'. Snap rings 117' hold the roller 115' in place on shaft 119'.

Because the frusto-conical surface sections 118' are provided on all three of the alignment rollers 115', each of the alignment plates 110' are positively held thereby to prevent the alignment plate 110' from shifting axially along any of the roller axes $A_{RL}$. The cylindrical surface sections 116' prevent the alignment plates 110' from rotating about the engine axis $A_E$.

It will also be seen from FIG. 19 that the oil diverting ring 258 on drive shaft 20 positively forces the oil from the oil distribution space 255 between shaft 20 and support tube 51 outwardly along piston port 265 and then back through piston port 266. This insures lubrication and cooling of the piston rings 56. Sealing rings 268 at the ends 60 of support tube 51 insure the proper oil flow.

COMPOSITE ENGINE

Figure 17:
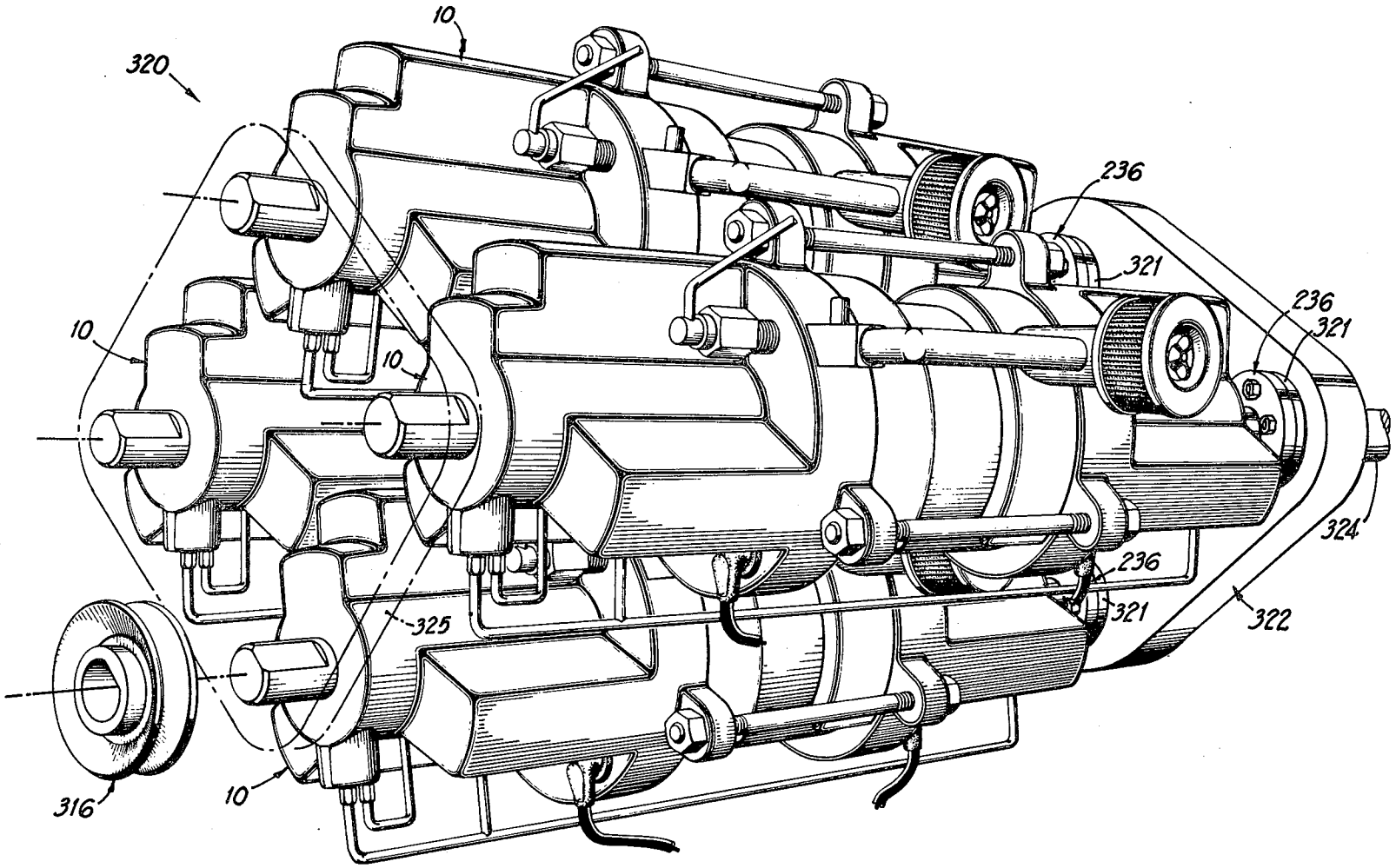
FIG. 17 is a perspective view showing a composite engine made up of a plurality of the engines seen in FIG. 1.

A plurality of the engines 10 may be interconnected in parallel or in series to provide a composite engine. FIG. 17 illustrates one composite engine labelled 320 which includes a plurality of the engines 10 interconnected in parallel. The output connectors 236 on engines 10 are connected to the input connectors 321 on a transfer gear box 322 (FIG. 17) so that the outputs of engines 10 are interconnected. The transfer gear box 322 has a common output drive shaft 324 driven by all of the engines 10.

The near ends 228 of engines 10 may be supported in a bearing plate 325 shown in phantom lines in FIG. 16 for clarity. Only one accessory drive pulley 316 is illustrated.

We claim:

1. An engine comprising:

a cylinder assembly having a cylinder central axis including a cylindrical annular side wall and a pair of cylinder heads closing the opposite ends of said side wall, said side wall and said cylinder heads defining a working chamber therein centered along said cylinder central axis, each of said cylinder heads defining a piston support passage therethrough from said working chamber concentrically about said cylinder central axis;

a piston assembly slidably mounted in said working chamber for movement along said cylinder central axis, said piston assembly including a piston slidably mounted in said working chamber in sealing engagement with said side wall; and a support tube affixed to said piston concentrically of and coaxially with said piston, said support tube extending coaxially outward from opposite ends of said piston for a prescribed distance so that said support tube slidably extends through both of said piston support passages in said cylinder heads in sealing engagement therewith as said piston moves from one end of said working chamber to the other, said piston assembly defining an axially extending drive shaft passage therethrough opening onto opposite ends of said support tube exteriorly of said cylinder heads;

an axially fixed drive shaft rotatably mounted in said drive shaft passage through said piston assembly so that said drive shaft can freely rotate within said drive shaft passage but remain axially fixed with respect to said cylinder assembly;

camming means interconnecting said piston assembly and said drive shaft to convert the reciprocatory motion of said piston assembly into rotary motion of the drive shaft;

valve means for selectively controlling the introduction of a working fluid into opposite ends of said working chamber;

supercharging means for selectively pressuriziing the working fluid for operating said engine prior to introduction of said working fluid into said working chamber, said supercharging means defining a supercharging chamber concentrically of said working chamber; and includeing a supercharger piston reciprocally mounted in said supercharging chamber, means exteriorly of said cylinder heads operatively connecting said support tube to said supercharger piston so that said supercharger piston is reciprocated in said supercharging chamber by motion of said piston assembly; and crossover means connecting each end of said supercharging chamber with said valve means so that pressurized working fluid at each end of said supercharging chamber is supplied to that end of said working chamber opposite the aforementioned end of said supercharging chamber.

2. An engine comprising:

a non-rotatable cylinder assembly having a cylinder central axis including a cylindrical annular side wall and a pair of cylinder heads closing the opposite ends of said side wall, said side wall and said cylinder heads defining a cylinder chamber therein centered along said cylinder axis, each of said cylinder heads defining a piston support passage therethrough from said working chamber concentrically about said cylinder central axis;

a piston assembly slidably mounted in said cylinder chamber for movement along said cylinder central axis, said piston assembly including a piston slidably mounted in said cylinder chamber in sealing engegement with said side wall; and a support tube affixed to said piston concentrically of and coaxially with said piston so that said support tubes moves with said piston, said support tube extending coaxially outward from opposite ends to said piston for a prescribed distance so that said support tube slidably extends through both of said piston support passages in said cylinder heads in sealing engagement therewith as said piston moves from one end of said piston support passages in said cylinder heads in sealing engagement therewith as said piston moves from one end of said cylinder chamber to the other to form a pair of working subchambers where each of the working subchambers is defined by said cylindrical annular side wall, one of said cylinder heads, said piston and said support tube, said piston assembly defining an axially extending drive shaft passage therethrough opening onto opposite ends of said support tube exteriorly of said cylinder heads;

a drive shaft;

drive shaft support means operatively connected to said cylinder assembly exteriorly of said cylinder chamber and rotatably mounting said drive shaft in said drive shaft passage through said piston assembly in clearance with said support tube so that said drive shaft can freely rotate within said drive shaft passage yet remain axially fixed with respect to said cylinder assembly;

camming means interconnecting said piston assembly and said drive shaft within said drive shaft passage to convert the reciprocatory motion of said piston assembly into rotary motion of the drive shaft; and alignment means engaging said support tube on said piston assembly exteriorly of said cylinder heads to prevent rotational movement of said piston assembly with respect to said cylinder assembly while permitting reciprocatory movement thereof within said working chamber.

3. The engine of claim 2 wherein said alignment means includes a first alignment assembly operatively associated with one of said cylinder heads and connected to that portion of said support tube on said piston assembly projecting through said one of said cylinder heads exteriorly of said cylinder head; and a second alignment assembly operatively associated with the other of said cylinder heads and connected to that portion of said support tube on said piston assembly projecting through said other of said cylinder heads exteriorly of said cylinder head.

4. The engine of claim 3 wherein said first alignment assembly includes first plate means affixed to that end of said support tube projecting through said one of said cylinder heads and movable with said support tube as said piston reciprocates without striking said cylinder head; first support means mounted on said one of said cylinder heads; and first alignment roller means movably interconnecting said first plate means with said first support means to permit said first plate means to move with respect to said first support means while preventing said first plate means and said support tube from rotating, and while maintaining said support tube concentrically of said central axis; and wherein said second alignment assembly includes second plate means affixed to that end of said support tube projecting through said other of said cylinder heads and movable with said support tube as said piston reciprocates without striking said cylinder head; second support means mounted on said other of said cylinder heads; and second alignment roller means movably interconnecting said second plate means with said second support means to permit said second plate means to move with respect to said second support means while preventing said second plate means and said support tube from rotating, and while maintaining said support tube concentrically of said central axis.

5. The engine of claim 4 wherein said camming means includes a first camming assembly carried by said first plate means and first cam slot means defined in said drive shaft in operative cooperation with said first camming assembly; and a second camming assembly carried by said second plate means and second cam slot means defined in said drive shaft in operative cooperation with said second camming assembly whereby said piston assembly is interconnected to said drive shaft such that the reciprocation of said piston assembly drivingly rotates said drive shaft.

6. The engine of claim 2 wherein said camming means further includes a pair of cam pins rotatably mounted in said piston of said piston assembly on opposite sides of said drive shaft, said cam pins located within the exterior confines of said piston and projecting into said drive shaft passage extending through said piston assembly, roller bearing means located within the exterior confines of said piston rotatably supporting said cam pins, and cam slot means defined in said drive shaft in registration with said cam pins so that said cam pins roll along said camming slot means as said piston assembly reciprocates within said cylinder chamber and so that the reciprocatory motion of said piston assembly is directly converted into rotary motion of said drive shaft in a first rotational direction so that said cam pins and said bearing means are isolated from said working subchambers.

7. The engine of claim 6 further including supercharging means for selectively pressurizing the working fluid for operating said engine prior to introduction of said working fluid into said working subchambers.

8. The engine of claim 7 further including valve means for selectively controlling the introduction of the working fluid from said supercharging means into said working subchambers and the exhaust of the working fluid from said working subchambers in timed relationship with the reciprocatory motion of said piston assembly within said cylinder chamber.

9. The engine of claim 8 wherein said valve means further includes at least one first rotary valve alternatively exhausting the spent working fluid from one of said working subchambers and introducing the intake working fluid from said supercharging means into one of said working subchambers and at least one second rotary valve alternatively exhausting the spent working fluid from the other of said working subchambers and introducing the intake working fluid from said supercharging means into the other of said working subchambers.

10. The engine of claim 9 wherein said valve means further includes gearing means connecting each of said rotary valves with said drive shaft to selectively rotate each of said rotary valves from its exhaust position to its intake position and to a sealing position upon prescribed motion of said piston assembly so that the working fluid from said supercharging means is introduced into said working subchambers and the spent working fluid is exhausted from said working subchambers in timed relationship with the reciprocatory motion of said piston assembly within said cylinder chamber.

11. The engine of claim 10 wherein said supercharging means defines a supercharging chamber concentrically of said working chamber; and includes a supercharger piston reciprocally mounted in said supercharging chamber, means exteriorly of said cylinder heads operatively connecting said support tube to said supercharger piston so that said supercharger piston is reciprocated in said supercharging chamber by motion of said piston assembly; and crossover means connecting that end of said supercharging chamber opposite that working subchamber associated with said first rotary valve with said first rotary valve and connecting that end of said supercharging chamber opposite that working subchamber associated with said second rotary valve with said second rotary valve so that pressurized working fluid at each end of said supercharging chamber is supplied to that working subchamber opposite the aforementioned end of said supercharging chamber.

* * * * *